US006471624B1

(12) United States Patent
Voris

(10) Patent No.: US 6,471,624 B1
(45) Date of Patent: Oct. 29, 2002

(54) METHOD FOR DETERMINING A BENCH PIVOT AXLE LOCATION ON A SUPPORT FRAME OF AN EXERCISE MACHINE

(75) Inventor: Harvey C. Voris, Huntington Beach, CA (US)

(73) Assignee: Paramount Fitness Corp., Los Angeles, CA (US)

( * ) Notice: Subject to any disclaimer, the term of this patent is extended or adjusted under 35 U.S.C. 154(b) by 0 days.

(21) Appl. No.: 09/563,805

(22) Filed: May 2, 2000

Related U.S. Application Data

(63) Continuation-in-part of application No. 09/232,094, filed on Jan. 15, 1999.

(60) Provisional application No. 60/071,602, filed on Jan. 16, 1998.

(51) Int. Cl.[7] ..... A63B 21/078

(52) U.S. Cl. ..... 482/142; 482/97; 482/136; 482/137

(58) Field of Search ..... 482/100, 142, 482/133–138, 97

(56) References Cited

U.S. PATENT DOCUMENTS 4,720,099 A * 1/1988 Carlson ..... 482/133
4,844,456 A * 7/1989 Habing et al. ..... 482/100
4,949,951 A * 8/1990 Deola ..... 482/100
5,069,447 A * 12/1991 Snyderman et al. ..... 482/133
5,074,551 A * 12/1991 Olschansky et al. ..... 482/137
5,342,270 A * 8/1994 Jones ..... 482/137
5,362,297 A * 11/1994 Muir ..... 482/134
5,370,595 A * 12/1994 Voris et al. ..... 482/100
5,462,510 A * 10/1995 Ish, III ..... 482/134
5,470,299 A * 11/1995 Yeh ..... 482/137
5,597,257 A * 1/1997 Habing ..... 482/100
5,603,682 A * 2/1997 Grider ..... 482/134
6,090,020 A * 7/2000 Webber ..... 482/100

* cited by examiner

*Primary Examiner*—Glenn E. Richman
*Assistant Examiner*—Victor Hwang
(74) *Attorney, Agent, or Firm*—Fulbright & Jaworski LLP

(57) ABSTRACT

An adjustable exercise machine using resistance for exercise the upper torso and arm muscles of a user comprises a bench assembly pivotally coupled to a support frame, and a seat support assembly for supporting and/or adjusting the user's body positions, the bench assembly being angularly adjustable for supporting the body at either incline, supine, or decline positions, and the seat support assembly being angularly and/or vertically adjustable in order to support the user's body such that shoulder joints of the user will remain approximately in a same plane, which also passes through a bench pivot axle, at all angular positions of the bench assembly during the exercise of the user.

8 Claims, 30 Drawing Sheets

Incline Press Position

Supine Press Position

Decline Press Position

Supine Chest Press

Incline Chest Press

Shoulder Press

METHOD FOR DETERMINING A BENCH PIVOT AXLE LOCATION ON A SUPPORT FRAME OF AN EXERCISE MACHINE

This application is a continuation-in-part of application Ser. No. 09/232,094, filed Jan. 15, 1999, abandoned, which claims the benefit of provisional application Serial No. 60/071,602, filed Jan. 16, 1998.

BACKGROUND OF THE INVENTION

1. Field of the Invention

The present invention relates generally to the field of exercise machines using resistance for exercising the upper torso and arm muscles for complete natural joint articulation of the shoulders, elbows and wrists. Particularly this invention relates to a bench assembly that may be angularly fixed such that the user is allowed to train the muscles of the arms and torso at different angles of isolation.

2. Brief Description of the Prior Art

Convergent plane chest and shoulder exercise machines were introduced by Hammer Strength Corporation in the late 80's and are covered by U.S. Pat. Nos. 5,050,873, 5,181,896, 5,135,456 and 5,044,631 issued to Jones. These machines operate with a pair of pivoting arm assemblies that rotate in convergent planes and take the user through an articulation that is more complete than conventional exercise machines. The primary drawback to the Hammer design is that these convergent plane style of machines are only beneficial to large users with long arm lengths. This is due to the fact that all users start at the same machine position regardless of body size.

U.S. Pat. No. 5,437,589 issued to Habing describes an upper body exercise machine with a machine-determined exercise motion path, which is also optimally suited for tall people, because the user is confined to start at a predetermined position and the ending position is also determined by the user's arm length. The machine has a pair of symmetrically articulated arm assemblies each being pivotally attached to the frame with a fourbar linkage. The handgrips of the Habing device are fixed and thereby do not allow the user complete and natural articulation at the wrist joint.

All of the machines of the prior art mentioned above are specifically designed for a particular angle of isolation, i.e. supine, incline or decline bench press movements. None of the prior art addresses the functional improvement of being able to do all three chest press movements on a single convergent exercise machine.

Adjustable incline and decline benches are not novel to the field of exercise equipment. The Paramount model PFW 6200 is an example of such a bench. Typically these benches are moved by the user into a squat rack or other similar apparatus to do incline, supine and decline chest press exercises with an olympic bar and free weights. Until the present invention it has not been possible to do all three chest press movements on one bench without having to physically move the bench and the lifting bar. Furthermore, the use of an adjustable bench with a squat rack or other apparatus only relates to traditional exercise movements and not the relatively new field of convergent exercise machines.

SUMMARY OF THE INVENTION

The preceding and other shortcomings of the prior art are addressed and overcome by various aspects of the present invention, which consists of an adjustable exercise bench that angles upwards or downwards to exercise and train the muscles of a upper torso and arms at varying angles of isolation.

The present invention comprises an adjustable exercise bench which is pivotally coupled to a support frame.

In the present invention is a method for varying the isolation in the muscles of the chest while providing complete, natural joint articulation of the shoulders, elbows and wrists by using a convergent pair of exercise machine arms. The muscle isolation is determined by the exercise bench angled relative to the machine pivot axle. The method includes defining the position of the bench pivot axle at a location in the plane positioned through the user's shoulder joints and at a displacement from the user's shoulder joints, and adjusting a seat position to accommodate the user into the aforementioned exercise positions. The seat or bench adjustments include angular and vertical adjustments to maintain the position of the user's shoulder joints relative to the bench pivot.

The resistance system of the preferred embodiments of this invention are free weights or individual weight plates placed on each arm via a weight post positioned for this purpose. The embodiments of this invention are not limited, however, to free weights and are easily adapted to other resistance means such as stacked weights, pneumatics or electrical motors.

By using the techniques of the present invention, three standard exercise machines are combined into one compact efficient machine. This substantially reduces floor space required in fitness facilities or residential installations.

The foregoing and additional features and advantages of this invention will be further shown by non-limitative examples in the detailed description and the accompanying drawing figures that follow. In the figures and written description, numerals indicate the various features of the invention, like numerals referring to like features.

DETAILED DESCRIPTION

This invention relates to an adjustable exercise bench for exercising the user's upper torso and arms, having an adjustable bench pad and seat and a pair of exercise arms attached on at least one pivot axle. The exercise arms are moving in a machine-determined circular exercise motion path. The position of the handles of the arms can be adjusted by varying the diameter of the machine-determined exercise motion path. Each exercise arm has a handle assembly with a pivot, preferably a wrist joint accommodating pivot. The wrist joint accommodating pivot and the arm pivot axle(s) allow the user's hand to move in a non-circular motion path. The machine arm pivot axle(s) are uniquely positioned so that the exercise motion path is optimal for individuals of all sizes and experience levels. Furthermore, the bench pivot axle and the seat adjustment have been optimally placed so that supine, incline and decline bench press movements can be performed without having to vary the arm pivot axle location in order to accommodate the user's exercise motion path for the three different exercises. The machine of the present invention can be made with a singular arm pivot axle, two co-linear arm pivot axles or two co-planar arm pivot axles.

Figure 1:
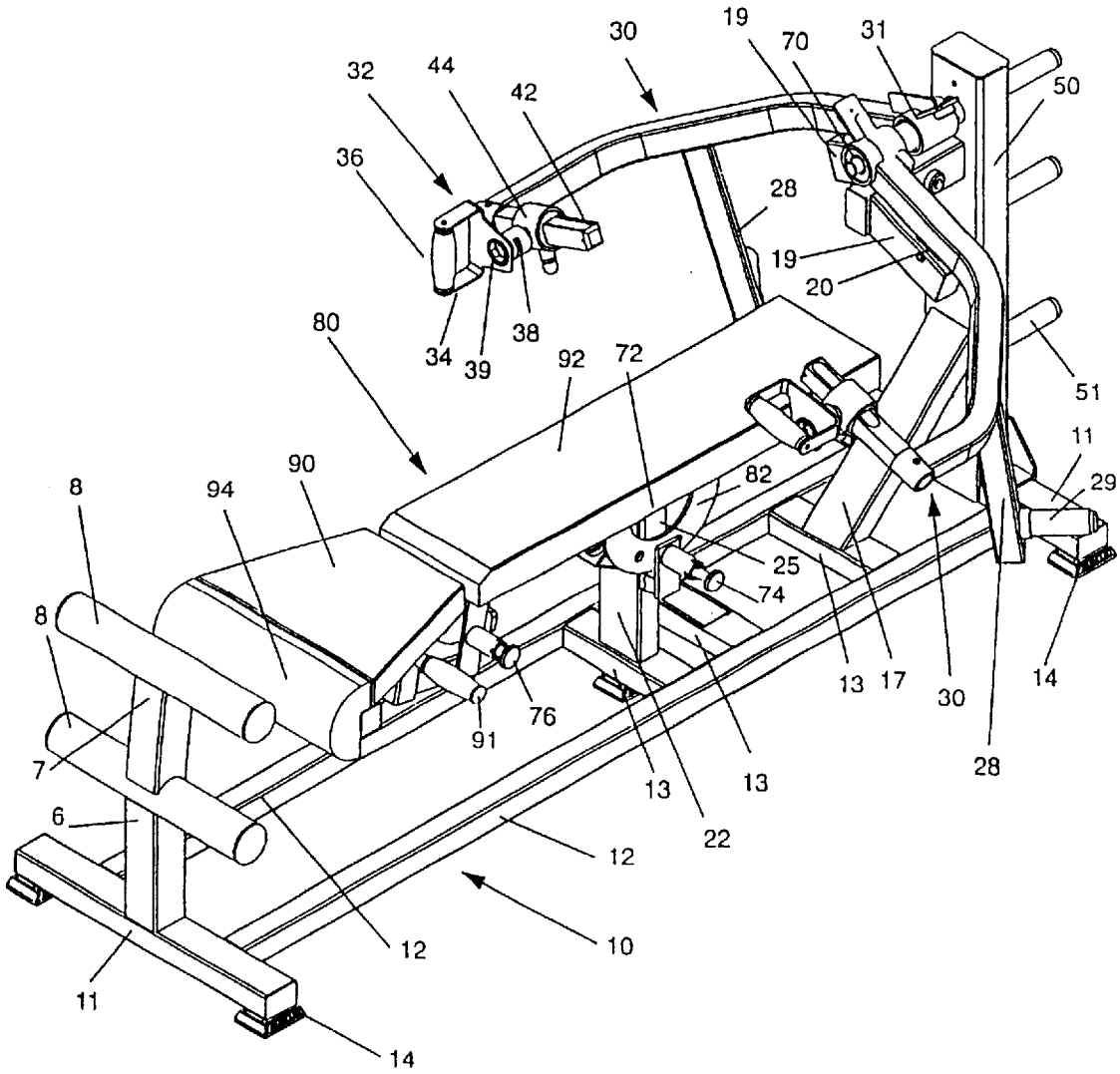
FIG. 1 is a perspective view of the exercise machine of the first embodiment of the present invention, having a singular axle with the bench in the supine press position.
Figure 8:
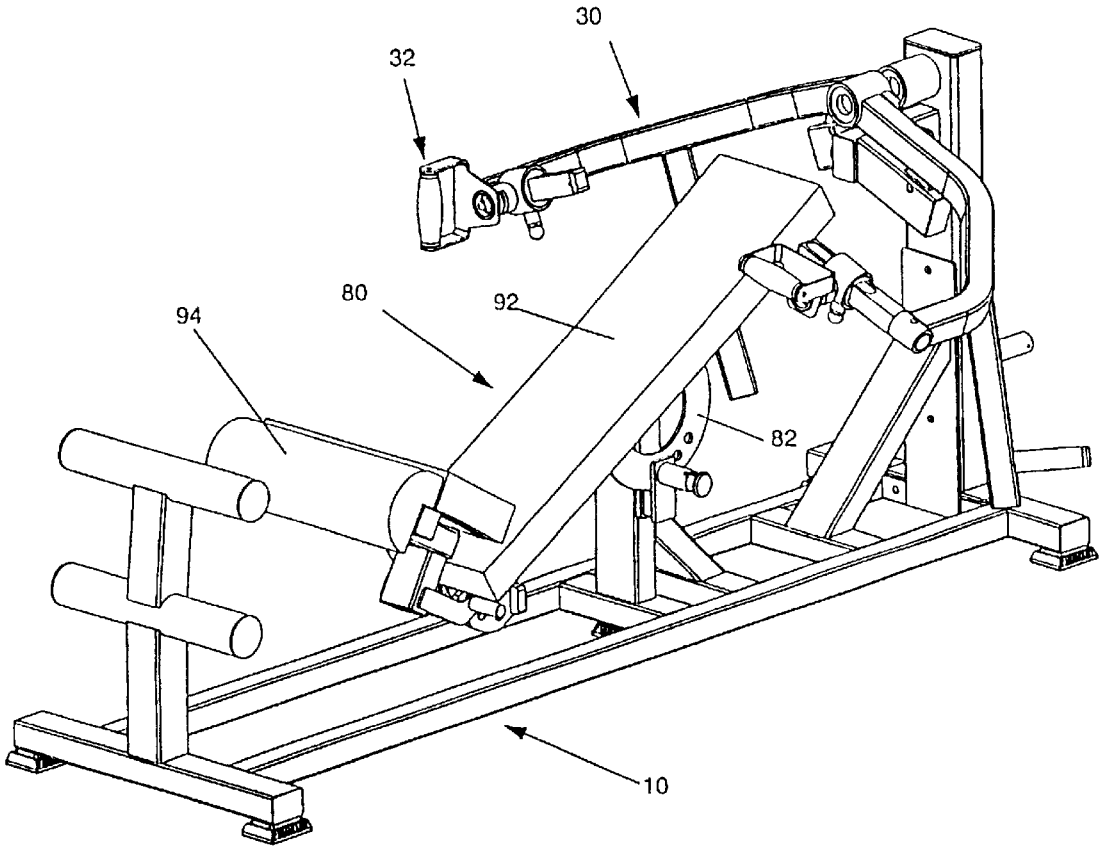
FIG. 8 is a perspective view of the machine to FIG. 1 in the incline press position.
Figure 9:
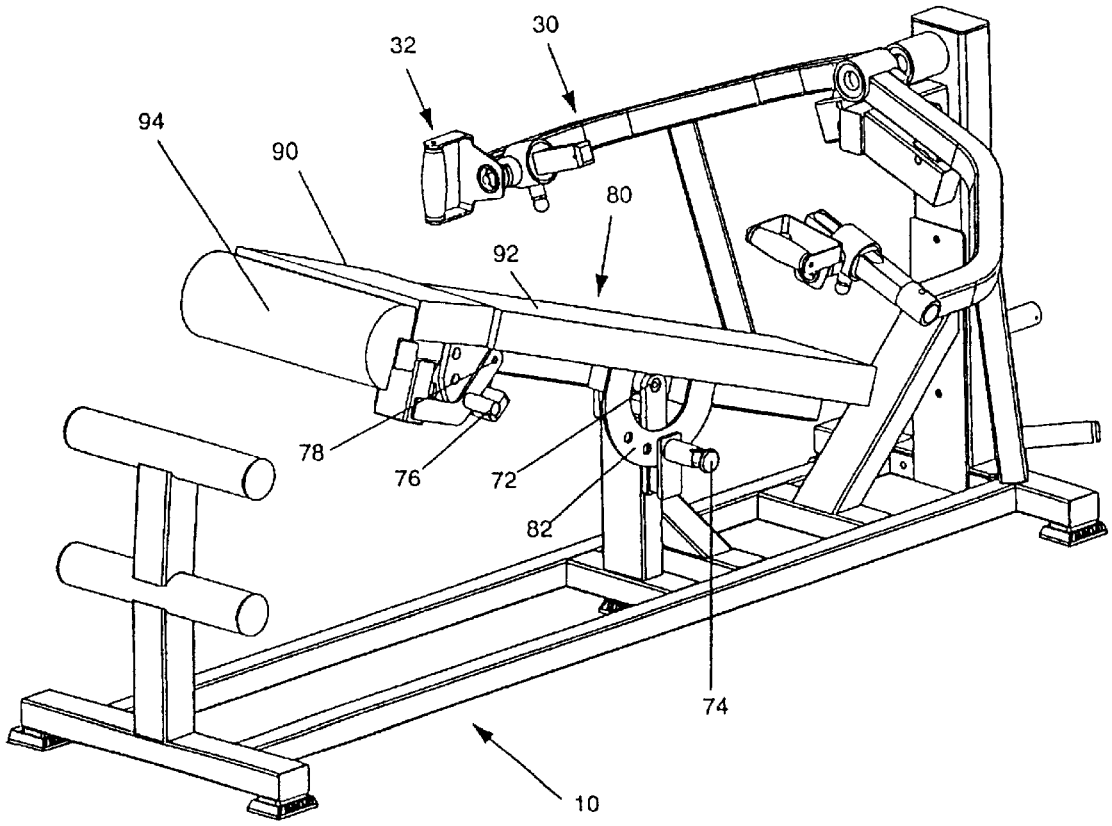
FIG. 9 is a perspective view of the machine to FIG. 1 in the decline press position.

FIG. 1 is a perspective view of the exercise bench, showing the basic architecture of a preferred embodiment of the present invention. The basic principles can be applied to each of the three exercise positions, shown in FIGS. 1, 8 and 9 and to machines with one or two arm pivot axles, FIGS. 1, 13 and 15. Therefore, in order to simplify the description, only the machine embodiment with a singular axle will be described in detail.

All bench positions of the present invention allow for complete shoulder, elbow and wrist joint articulation through natural ergonomic exercise motion paths. The user's shoulder, elbow and wrist joints are taken through their complete ranges of motion during the course of exercise movement at each selected bench position without wrist impingement, thus decreasing stress in the joints and providing for proper muscle isolation.

Figure 7A:
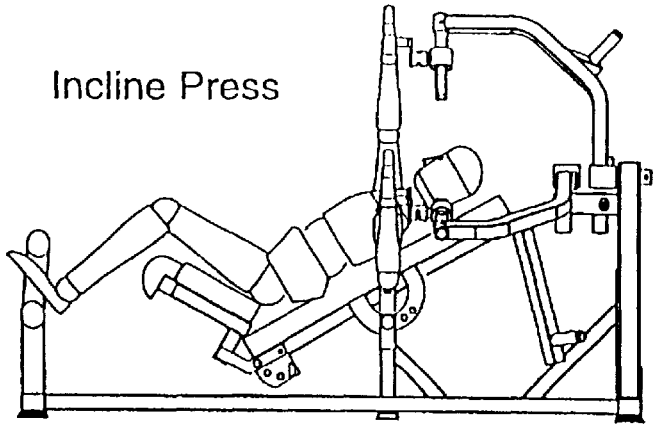
FIGS. 7*a*, 7*b*, and 7*c* are side views of the machine from FIG. 1 with a user positioned in each of the three exercise positions illustrating the aligned shoulder/hand position.
Figure 7B:
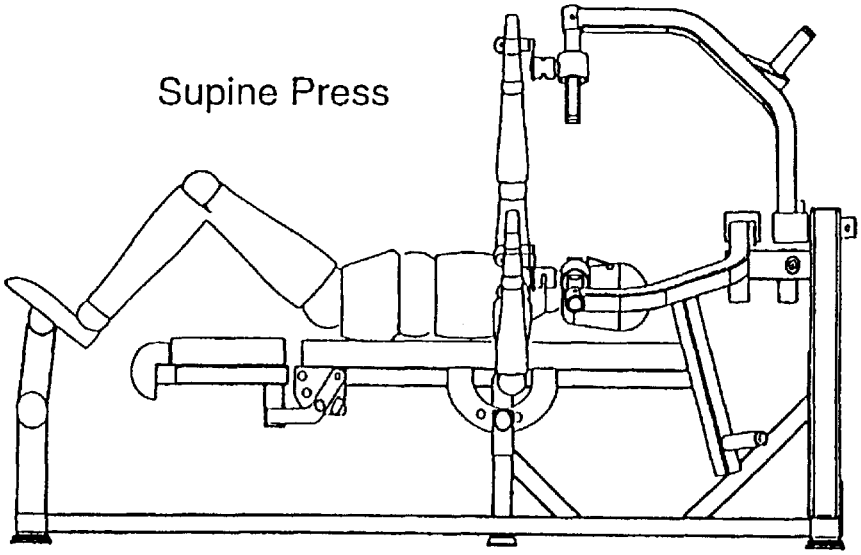
Figure 7C:
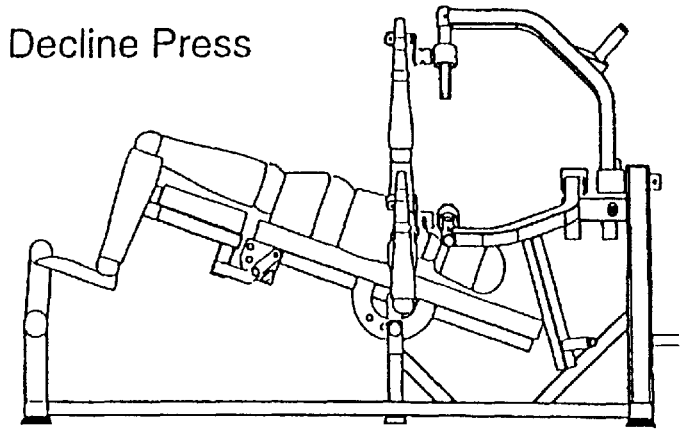

As shown in FIG. 1, the exercise bench of the present invention has a sturdy and rigid frame 10. The frame 10 is a combination of individual straight and curved frame members of preferably structural steel tube and plate. The individual tubing sizes can range from preferably 2" square to 3"×5" rectangular. Structural steel plate thicknesses range from preferably ¼" to ¾". Round axles and pins are preferably steel and range from ½" diameter cross section to 1½" diameter cross section. The frame 10 is preferably covered with an electrostatically applied powder coat finish, for enhanced appearance and durability. The individual frame members are joined together by welding, mechanical fasteners or other appropriate means. Individual base frame members 11–13 are joined and supported above the floor on custom molded feet 14, to insure stability of the exercise bench and prevent marring of the floor surface. A vertical frame assembly 50 extends upwardly from the rear base frame member 11. Frame members 6–8 are joined to form foot support components at the front end of frame 10 rising upwardly from the other frame member 11. As shown in FIGS. 7*a*–7*c* two foot supports 8 are required to accommodate the user in each of the exercise positions. The placement of the foot supports 8 is dependent on the height of the bench pivot axle 72 and a final bench angle y (see FIG. 3*a* where the height of pivot 72 is 14.1").

Figure 3A:
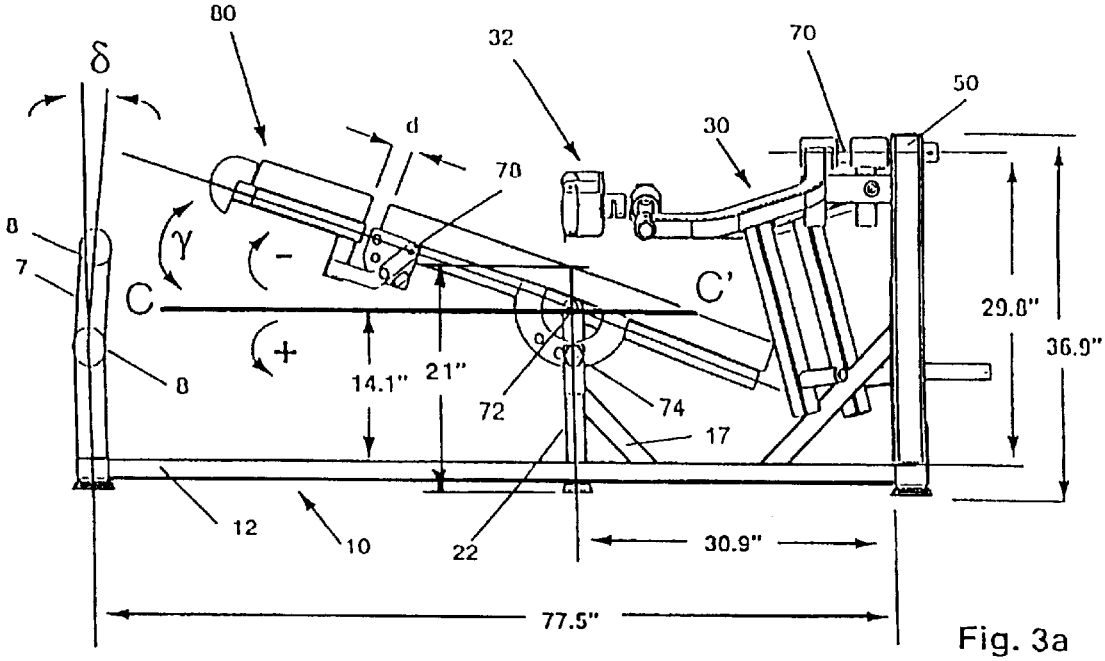
FIG. 3*a* is a side view of the machine from FIG. 1 in the decline press position.

FIG. 3*a* shows a side view of the exercise bench of the present embodiment in the decline bench press position. The bench angle γ, defined as the angle of inclination of bench assembly 80 with respect to a horizontal plane C–C' through pivot axle 72 with−being upward of plane C–C' and +being downward, preferably shall fall within the range of +/−30° with −20° being the optimum decline angle and +30° being the optimum incline angle. When γ is at the optimum of−20° the preferable overall heights of the two foot supports 8 shall be 12" and 21.7" respectively above the base frame member 12. As is shown in FIG. 3*a*, the upper foot support 8 is placed closer to vertical frame assembly 50 than is the lower foot support 8. This offset is defined by an angle δ and the length of frame tube 7. This positioning is suitably established for a wide range of users with proper foot retention when performing the decline press movement as shown in FIG. 7*c*. When the bench angle γ is optimized at −20°, the angle δ is preferably between 3° and 8° with 5° being optimum and the length of frame tube 7 between 6" and 10" with 8.5" being optimum.

Figure 3B:
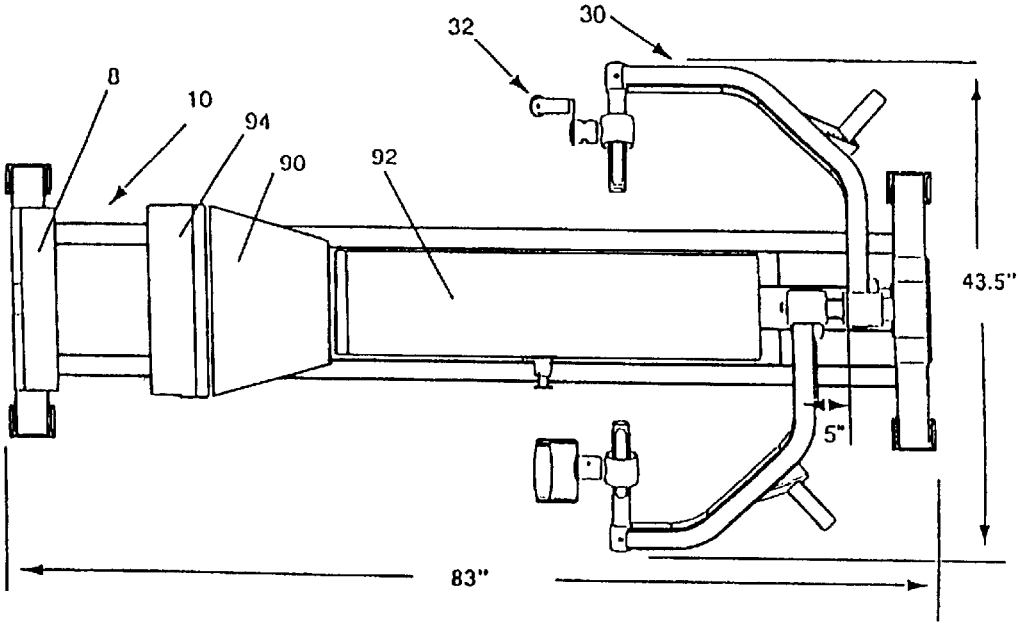
FIG. 3*b* is a top view of the machine in FIG. 1 in the decline position.
Figure 4:
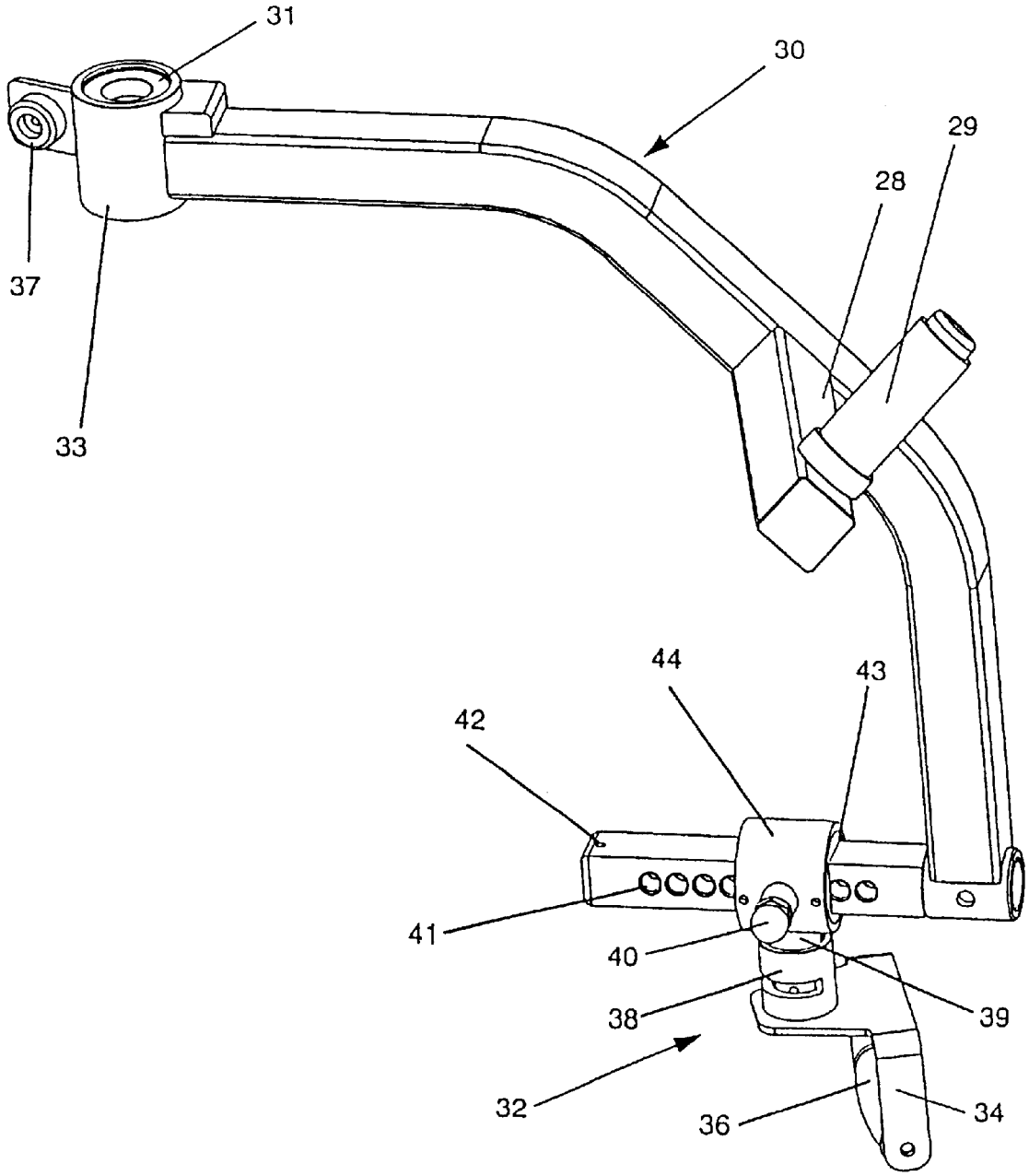
FIG. 4 is a perspective view of an exercise arm of the machine in FIG. 1 of the present invention.

Exercise arms 30 are preferably formed from 2" square steel tubing and consist of the elements shown in FIG. 4. Arms 30 rotate on sealed bearings 31 on axle 70 (FIG. 1) which is preferably welded or pinned to vertical frame assembly 50. In the preferred design shown in FIG. 1, arms 30 are not the same length, i.e., the longer arm is placed further back on axle 70 than the shorter arm thus keeping the handles 32 moving in the same plane relative to one another. In the bench of the preferred embodiment of FIG. 1 this offset is preferably in the range of 3" to 6" with 5" being optimum as shown in FIG. 3*b*.

Handle adjustment assembly 44 may be positioned in any one of preferably 9 adjustment holes 41 along adjustment bar 42 and retained with adjustment pin 40. Adjustment bar 42 is preferably made from ½" square steel and teflon coated to allow ease in adjusting handle adjustment assembly 44. Handle adjustment assembly 44 further contains two adjustment sleeves 43 having square cross section with approximately 1½" dimension suitable to encircle the adjustment bar 42 and being preferably constructed of fiberglass with a teflon backing. The adjustment of handle assembly 44 along adjustment bar 42 determines the diameter of the machined-determined arcs 400, 402, 404 shown in FIG. 19. The diametrical values of arcs 400, 402 and 404 are preferably within the range of 26" to 38" thereby accommodating users from 5th percentile female to 95th percentile male. Exercise handles 32 are fixedly retained onto wrists accommodating pivots 39 of handle adjustment assemblies 44 by retaining rings or other suitable means. Not shown Exercise handles 32 rotate on accommodating pivots 39 on bearings 38. Further, handles 32 consist of formed stirrups 34 that retain handles 36 forward of wrist accommodating pivots 39 thereby sufficiently aligning the user's wrist joints with the wrist joint accommodating pivots 39.

Figure 2:
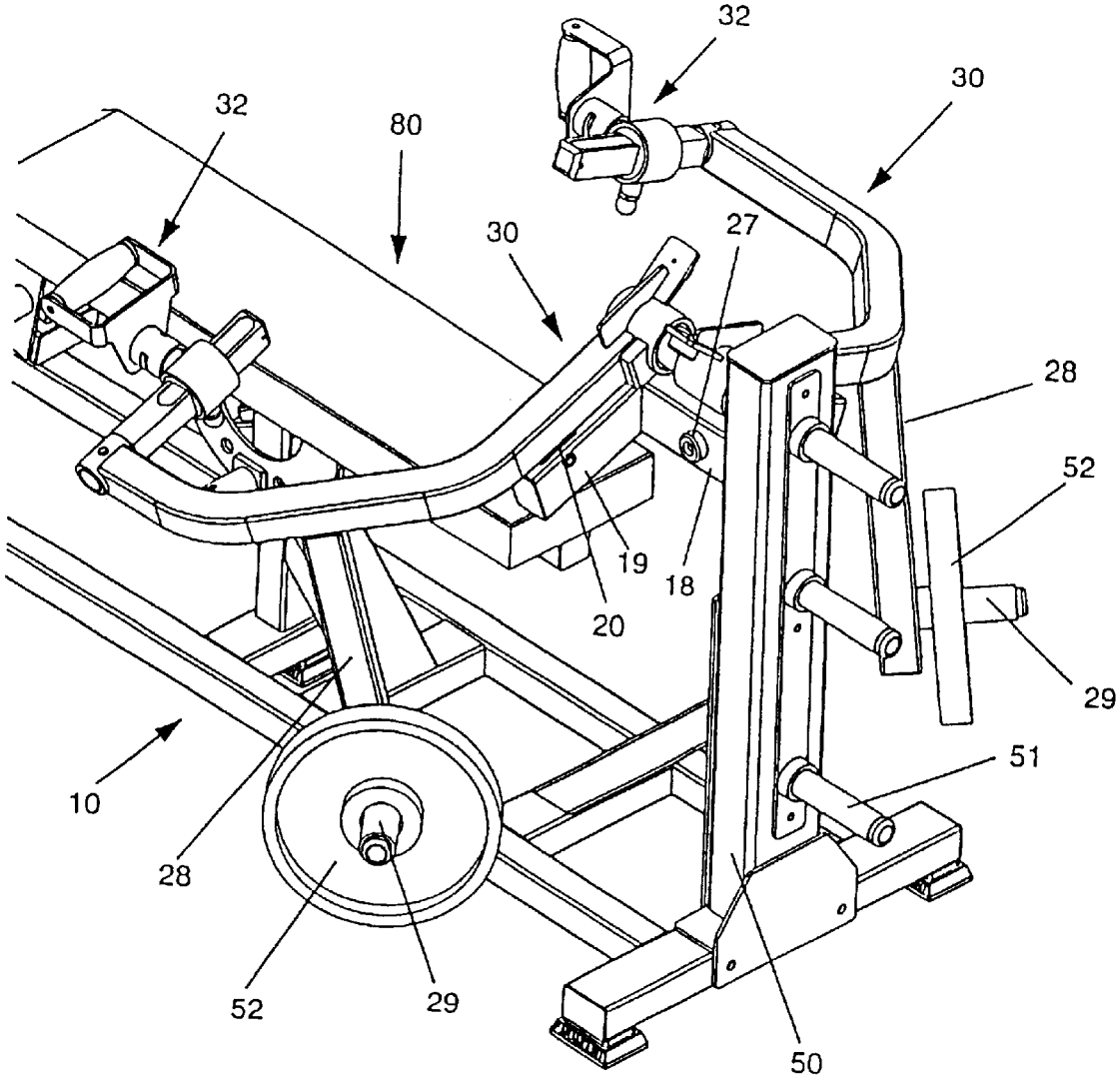
FIG. 2 is a rear perspective view of the machine in FIG. 1 showing the mounting location for the weight plates.
Figure 5A:
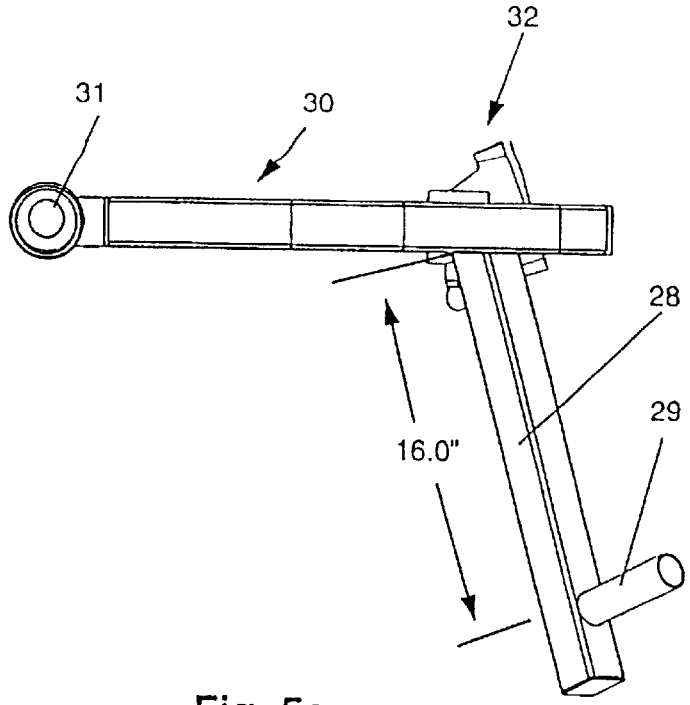
FIGS. 5*a*, 5*b* are rear and top view representations of the exercise arm of FIG. 4.
Figure 5B:
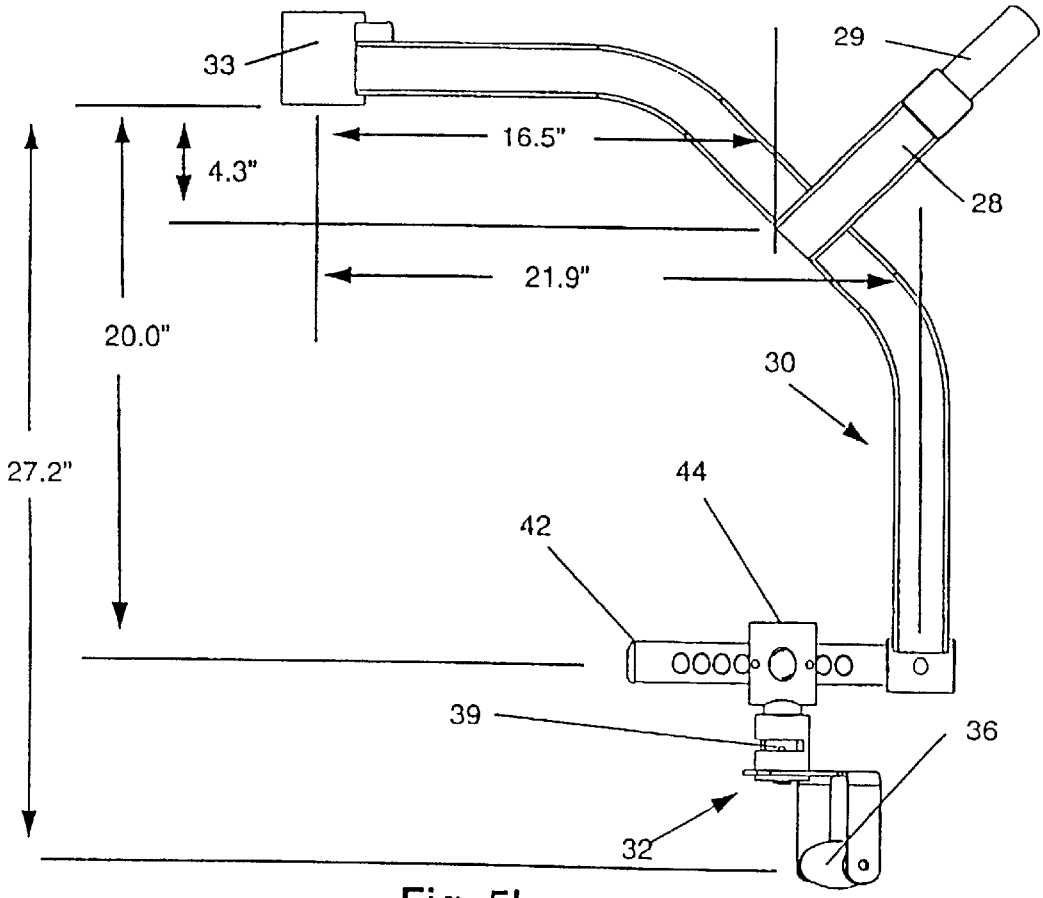

The machine of the preferred embodiment of FIG. 1 utilizes "free weights" or individual weight plates 52 FIG. 2 as the resistance means although it should be appreciated that adaptation to other resistance means such as stacked weights, pneumatics or electric motors would be fairly straight forward to a person skilled in the art. In order for the present invention to be accepted by experienced weight lifters the resistance profile or "feel" of the movement must be consistent or uniform. To achieve this, the length and positions of the weight support arms 28 were optimized on the respective arm assemblies 30. Weight support arms 28 are preferably made of 2" square tubes and 10" to 18" long, with 16" long being optimum. When the arm assemblies 30 are in rest position, the junctions of the weight support arms 28 and the respective arm assemblies 30 are laterally displaced by 10" to 18" from either side of the centerline of bearing 31 and 1" to 6" perpendicular toward the bench assembly 80 from the edge of bearing retention tube 33. Optimum dimensions for the junction location of support arm tube 28 on exercise arm 30 of the bench of the preferred embodiment of FIG. 1 are 16.5" lateral and 4.3" perpendicular as shown in FIG. 5*b*. As shown in FIGS. 1 and 3*b*, support arms 28 are angled backwards relative to a vertical reference plane. This is preferred so that weights 52 are retained on weight posts 29 throughout the entire exercise motion path. To achieve this, each support arm tube 28 is coupled to the arm assembly 30 at an angle relative to a vertical plane on the proximate end of tube 28 of between 10° and 30°, preferably 20°. Weight post 29 is perpendicular to tube 28 (FIG. 5*a*) and is preferably steel tube 1¼" diameter to 1⅞" diameter preferably 1½" diameter and of sufficient length to retain at least three 45 lb weight plates. In the preferred design of FIG. 1 weight posts 29 are 4.9" in length.

It should be appreciated that the resistance felt by the user is the result of simple engineering mechanics and that the sizing and placement of weight support tube 28 is rather fundamental. To achieve greater resistance for a given weight amount, weight tube 28 would be larger and placed further from the centerline of bearings 31 or axle 70. To reduce the resistance effect of a given weight, support tube 28 would be shortened and placed closer to axle 70.

Providing the user with adequate range of motion is important in the design of convergent exercise machines. Not only is the machine-determine arc important but also starting and ending points of the movement of the arm assemblies 30. The ending point of the movement for the machine of the preferred embodiment is determined by the point at which handles 32 collide. The beginning point of the movement is determined by the positions of stops 20 and stop frame members 19. For the bench assembly 80 of the preferred embodiment in FIG. 1, a downward angle of arm assemblies 30 with respect to a horizontal reference plane through axle 70 is between 10° and 25°, with 20° being optimum. This angular positioning correlates with the placement of other bench parameters detailed below to give the widest possible range of user's a comfortable starting and returning positions. Stops 20 are preferably of rubber composition and are positioned to make contact with the undersides of arms 30. Stop frame members 19 are sized accordingly to allow this to occur and are fixedly attached to vertical frame assembly 50 preferably by welding.

Figure 6:
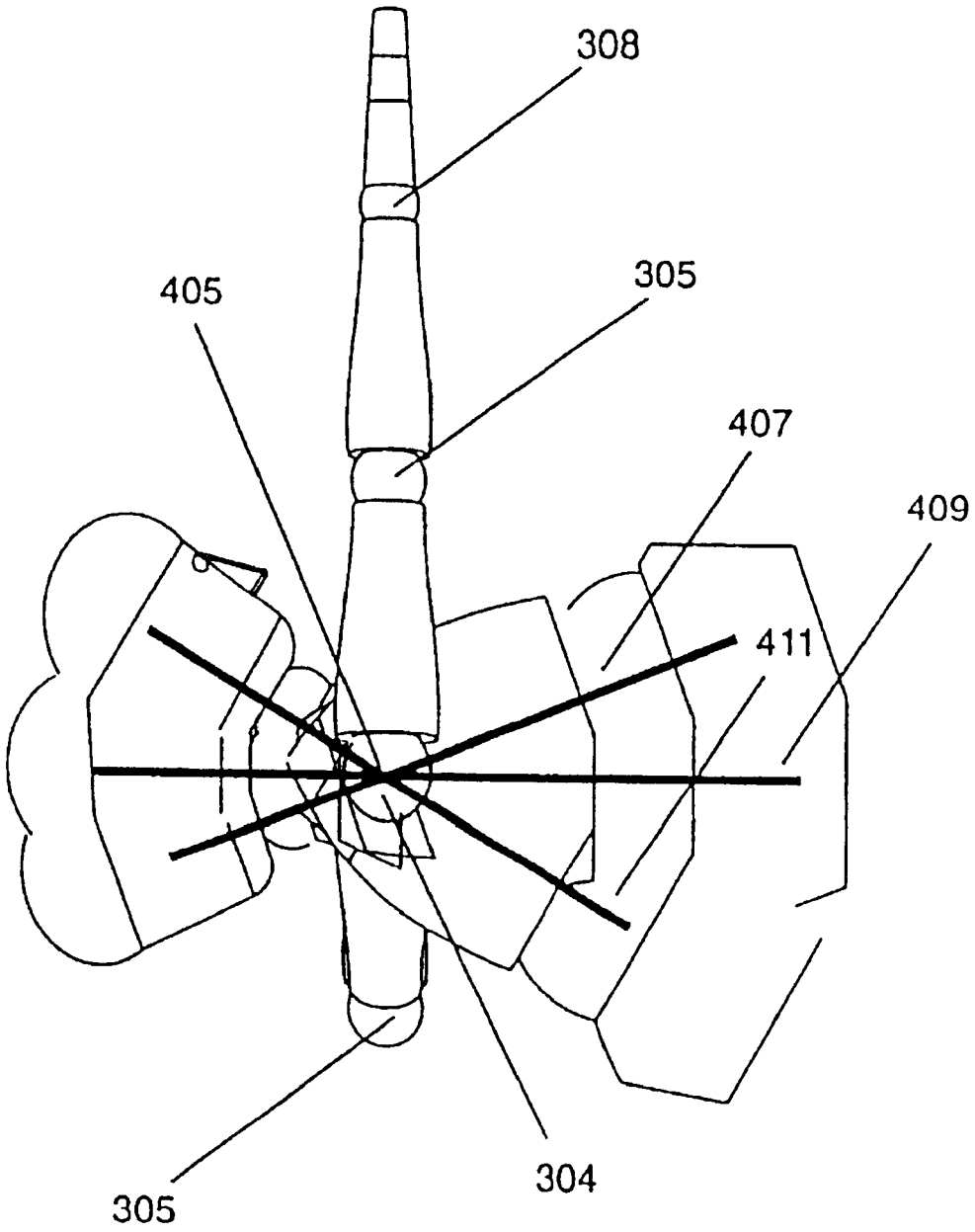
FIG. 6 is a side view compilation of the user in a beginning and ending position for the three exercise positions showing the ideal alignment of the shoulders and hands in each of the three positions.
Figure 18:
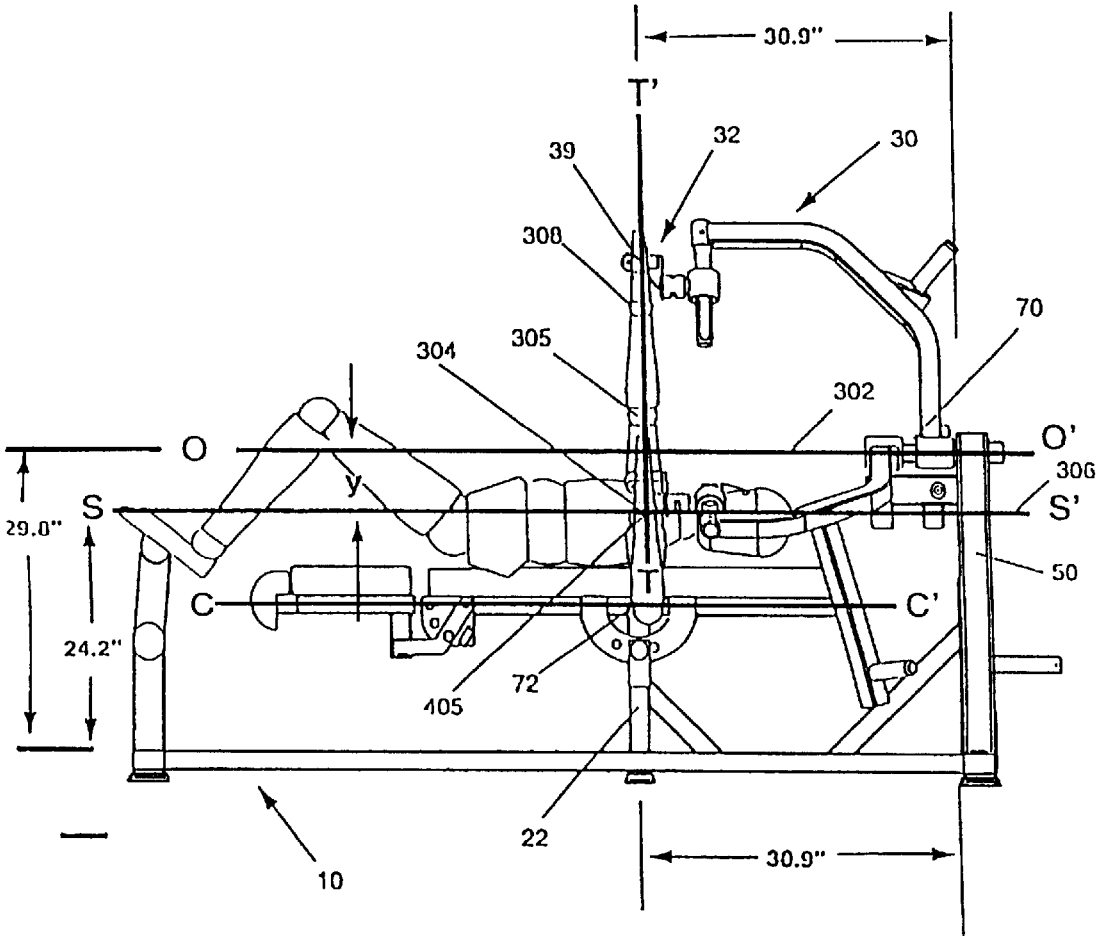
FIG. 18 is a side view of the user in a beginning and ending position for the supine exercise positions showing elements of FIGS. 1, 16 and 17.

Referring to FIG. 6, the user's shoulder joints 304 can be fixed in space along an axis 405. The user's arms and thus elbows 305 and wrists 308 can be restrained to articulate in a vertical plane T–T', as shown in FIG. 18. With these constraints established, the user's body can then be placed in either the supine position 409, substantially inclined 411 or substantially declined 407 orientations while maintaining the vertical nature of his/her arms and plane T–T' and the placement of axis 405. For stability and structural integrity, vertical frame assembly 50 and arm pivot axle 70 must be rigid with their relative positioning to the rest of the bench components staying constant. The theoretical best case would be to place bench pivot axle 72 coincident with axis 405 thereby insuring proper alignment. This is not possible due to the very nature of the exercise and the body's positioning on the machine. Therefore, the placement of bench pivot axle 72 required optimization to keep the user's shoulder joint 304 and the motion path of the user's arms as close to 405 and plane T–T' as possible.

In the bench of the preferred embodiment, three exercise movements are to be performed and the user must be comfortable in each position. In the bench of the preferred embodiment shown in FIGS. 3 and 7*a*–7*c*, to accommodate all three exercises the top surface of, bench assembly 80 in the supine position (γ=0°) is placed 19" to 23" above the floor with the preferable dimension of being 21.0". This correlates with the expectations of most experienced users that are accustomed to supine benches with the bench pad at 18–22" from the floor. This placement also allows the function of bench assembly 80 in the incline position and does not make entry onto the bench difficult in the decline position. In the bench of the preferred embodiment, with the top surface of bench assembly 80 set 21" above the floor, the shoulder axis 405 lies preferably 30.9" forward of vertical frame member 50 and preferably 24.2" vertically above base frame member 12. Bench pivot support frame 22 extends vertically from a cross frame tube 13 and is positioned preferably 29"–33", with 30.9" being optimum, in front of the vertical frame member 50. Gusset support tubes 17 extend up angularly, at preferably 450, from a cross frame tube 13 to add rigidity to frame 10. Bench pivot axle 72 is retained between pivot plates 25 and 26 (see FIG. 10) and positioned vertically above the base frame member 12 by 12" to 16" with 14.1" being the optimum. This placement of pivot axle 72 is such that when bench assembly 80 and seat pad 90 are placed in any of their possible positions, γ in FIG. 3 and θ in FIG. 11, the user's shoulder joint 304 will always be placed between 29.5" and 32", preferably 30.9", forward of frame 50 and between 22.5 and 26", preferably 24.2", vertically above the frame member 12. These boundaries define a functional window or zone around the optimum position in which it has been found that the bench functions properly. This placement of pivot axle 72 allows arms 30 and handles 32 to rotate in machine determined arcs about fixed axle 70 taking the user's arms through natural articulation without compromise or impingement. If axle 72 falls outside of the parameters detailed above, user shoulder joints 304 will not be sufficiently coincident with axis 405 and unnatural or incomplete motion paths will be attained when attempting to perform the incline or decline bench press movements.

FIGS. 7*a,b,c*, 8 and 9 show the possible positions of the exercise bench of the preferred embodiment of FIG. 1. The aforementioned placement of axles 72, 70 and bench assembly 80 assist in the proper placement of the user onto or into the bench. This proper placement is further augmented by the functionality of bench assembly 80 with respect to longitudinal adjustment of the user for the incline press movement, support of the user's legs in the decline position and adequate head support for the supine and incline press movements. It is always best to keep adjustments to a minimum to reduce user confusion, speed transition between users/exercises, and minimize maintenance. For these reasons the adjustment between pads 92 and 90 of FIG. 10*b* that alters placement of the user's body for a proper alignment in the incline press movement and supports the user's upper and lower body for the supine and decline press movements can be achieved by a single angular adjustment shown in FIGS. 10*b* and 11 as opposed to linear or parallel seat adjustment as is common in the trade. If the more traditional seat adjustment were used, seat pad 90 would adjust substantially perpendicular to back pad 92. To place seat pad 90 in the proper orientation for the supine or decline exercises, i.e. parallel to back pad 92, the user would need to perform an additional adjustment. The angular adjustment of pads 90 and 92 of the exercise bench of the preferred embodiment therefore removes this additional adjustment that would be required to return the pads to the flat or parallel state.

Figure 10A:
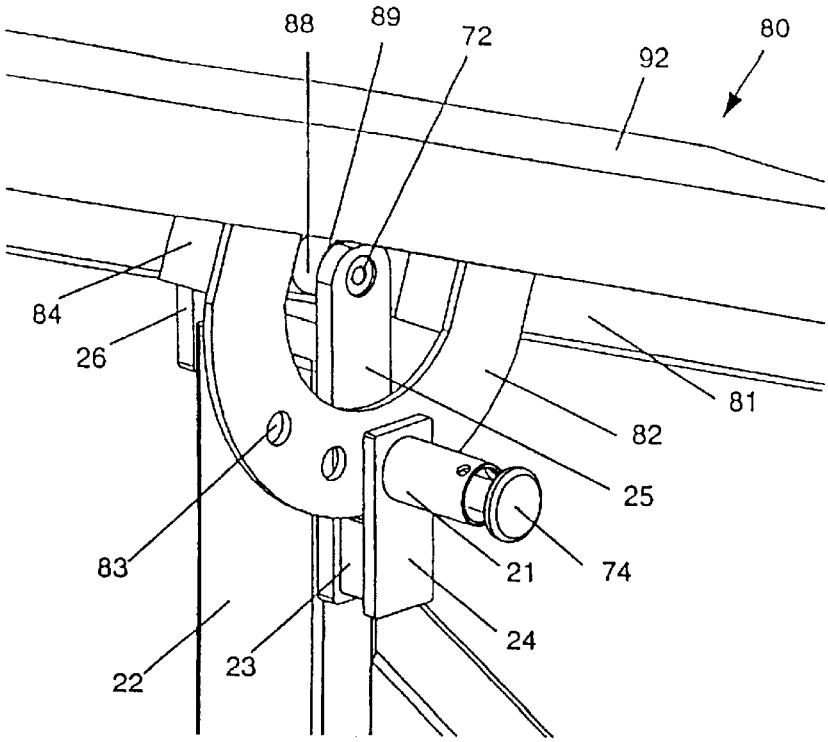
FIGS. 10*a* and 10*b* are perspective views detailing the elements of the adjustable bench frame and adjustable seat frame of the machine in FIG. 1.
Figure 10B:
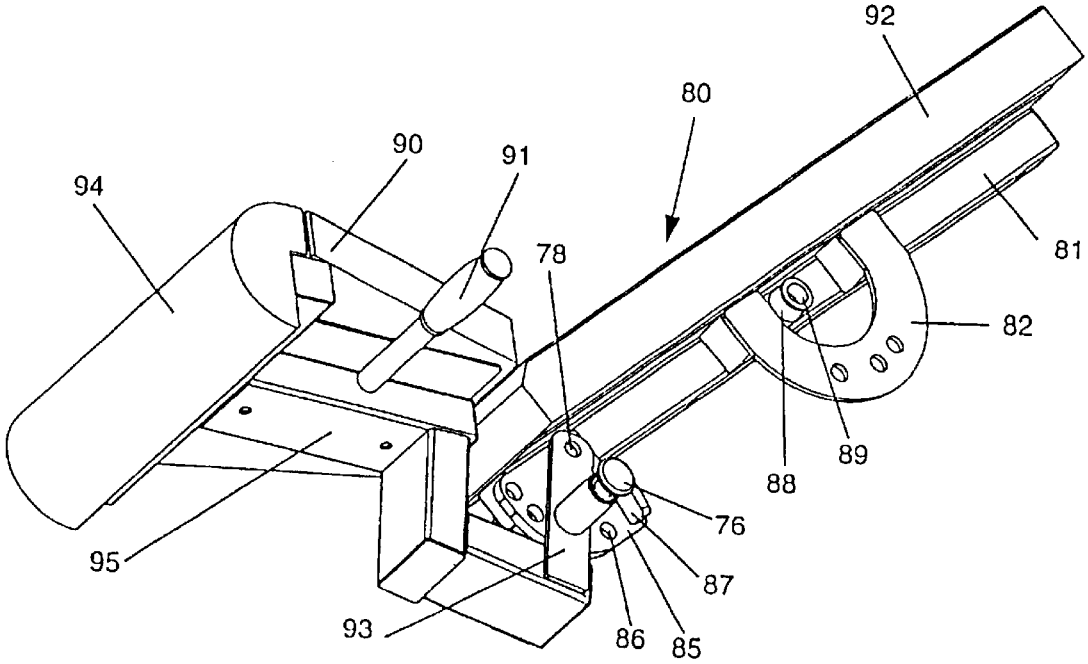
Figure 11:
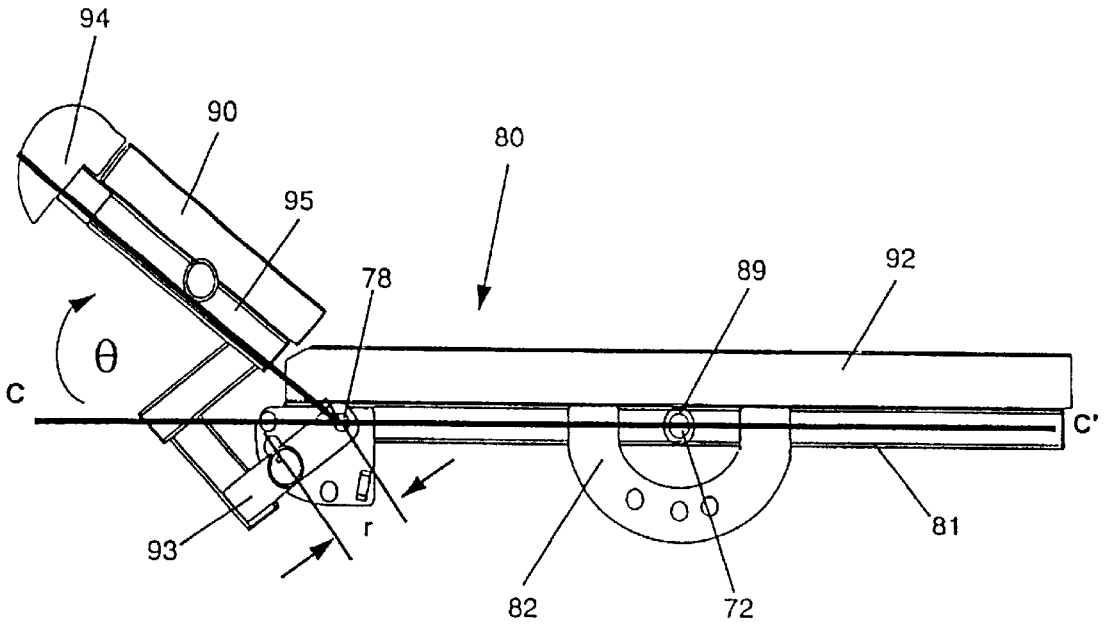
FIG. 11 is a side view illustrating the positions possible for the seat frame of the adjustable bench of FIG. 10.

In the exercise bench of the preferred embodiment shown in FIGS. 1 and 10, seat pad 90 and leg support pad 94 are fixedly attached to seat frame 95. Welded to frame 95 are two offset plates 93 one of which is shown in FIG. 10*b*. Plates 93 retain seat pivot axle 78 within its sleeve tube located at the distal end of bench frame tube 81. As shown in FIGS. 10*b* and 11, seat frame 95 rotates about pivot axle 78 through and arc and can be fixed at an angle θ within a preferred range of 0° to 80° by engagement of pin 76 in any of the holes 86 of adjustment plate 85. Three adjustment holes 86 are shown in the exercise bench of the preferred embodiment allowing 60° of angular adjustment. Adjustment pin 76 is preferably ¾" diameter steel radially offset from the pivot axle 78 at a preferred dimension r of 3.5" as shown in FIG. 11. It should be appreciated that the incremental change in θ is a function of the number of holes 86 in plate 85, the diameter of pin 76, and the radial offset r. These dimensions for the exercise bench of the preferred embodiment have been established so that when pads 92 and 90 are parallel or flat, as would be the case for the supine and decline exercises, they are as close together as possible. A large separation between these two pads is undesirable as the user would sense the gap and feel insecure or inadequately supported for the supine and decline exercises. In the exercise bench of the preferred embodiment this separation between pads 92 and 90 is defined as d shown in FIG. 3*a* and shall fall within the range of 1" to 2.5" with 1.8" being optimum. As the angle θ increases the user would be moved up along bench pad 92. An increase in angle θ therefore accommodates shorter users while a smaller angle θ would be used by taller users. This angular adjustment provides substantially the same seat position adjustment as afforded by more traditional perpendicular means discussed above.

The size and shape of pads 90, 92 and 94 have been optimized to provide the user with adequate support for each of the three exercises and allow freedom of limb movement to execute the exercises properly. Bench pad 92 is substantially rectangular in shape and has been optimized to 9.5" wide×39.5" in length. These dimensions provide adequate head support for the three exercise movements and allow for complete shoulder retraction at the beginning and ending of the motion arcs. The width of the pad can range from 8" to 10.5" and the length from 37" to 46" and still meet the basic support parameters. Leg support pad 94 is substantially "comma" shaped with the arc of the comma being of preferred 3.0" radius. This pad supports and retains the user while in the decline position. Therefore, it must be wide enough to substantially support both legs. In the exercise bench of the preferred embodiment pad 94 is preferably between 15" and 20" long with 17.3" being optimum. The comma shape of this pad further supports the posterior surface of the user's lower legs. Seat pad 90 is preferably triangular in shape meeting the dimensions established by leg pad 94 on one end and bench pad 92 on the opposite end. The height or length of pad 90 is established by the dimension required to support the largest range of users while maintaining the largest range of user's arms in plane T–T' and shoulders along axis 405. The preferred length of pad 90 therefore shall fall within the range of 9" to 14" with 11.3" being optimum.

Exercise arms 30 swing upward in parallel with plane T–T' in a predefined arc about arm pivot axle 70 preferably pinned or welded into vertical frame assembly 50. The handle assemblies 32 pivot on the wrist joint accommodating pivots 39 and come together at the end of the exercise movement. In the exercise bench of the present invention shown in FIG. 1, the single central pivot for the exercise arms 30, axle 70, has a vertical displacement between 28" and 31", preferably 29.8", above frame 12. This positioning has been optimized based on the positioning of axis 405 and bench pivot axle 72 described above. When axle 70 is positioned within the 28" to 31" range the users arms are allowed complete natural articulations at any bench angle γ. This positioning further corresponds to a perpendicular offset γ, shown in FIGS. 16 and 18, of 4 to 6¼", preferably 5⅝", from a plane positioned through the user's shoulder joints 304 and axis 405 when the user is in the supine bench press position.

Figure 12:
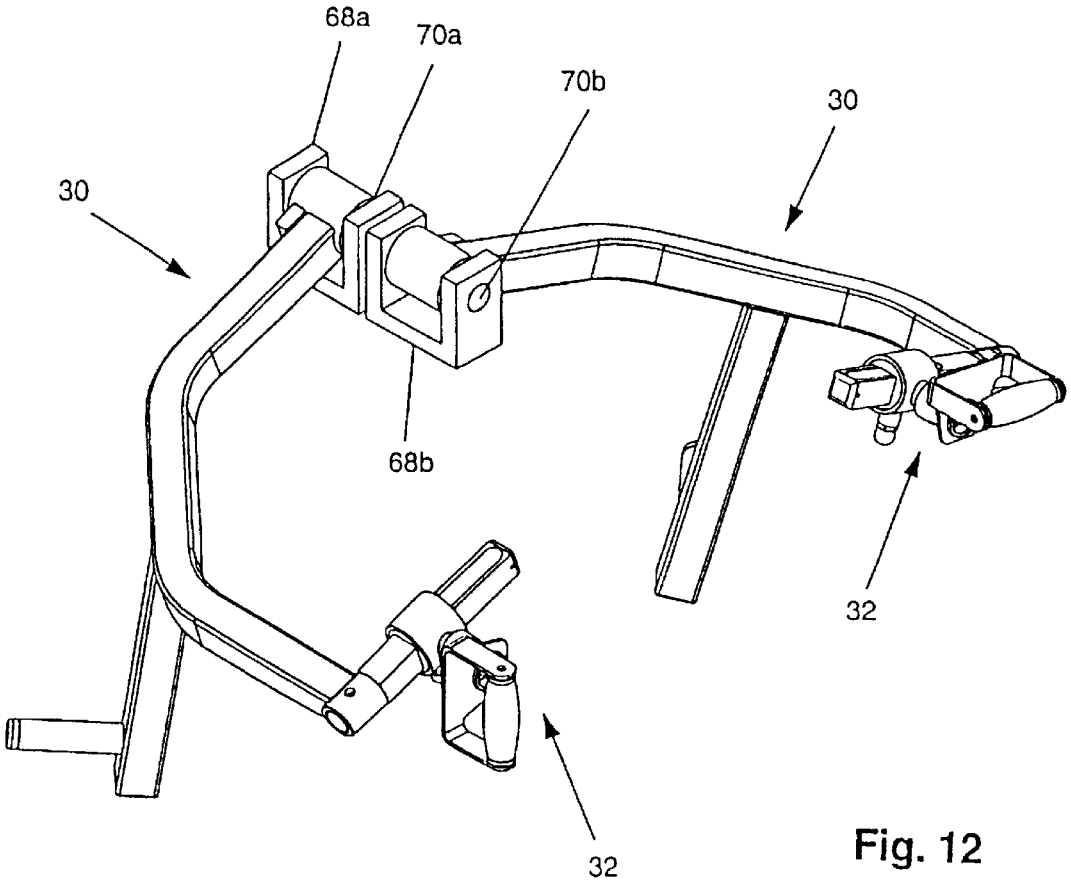
FIG. 12 is a perspective view of the position of two exercise arms for the embodiment of the present invention with co-linear arm pivot axles.
Figure 13:
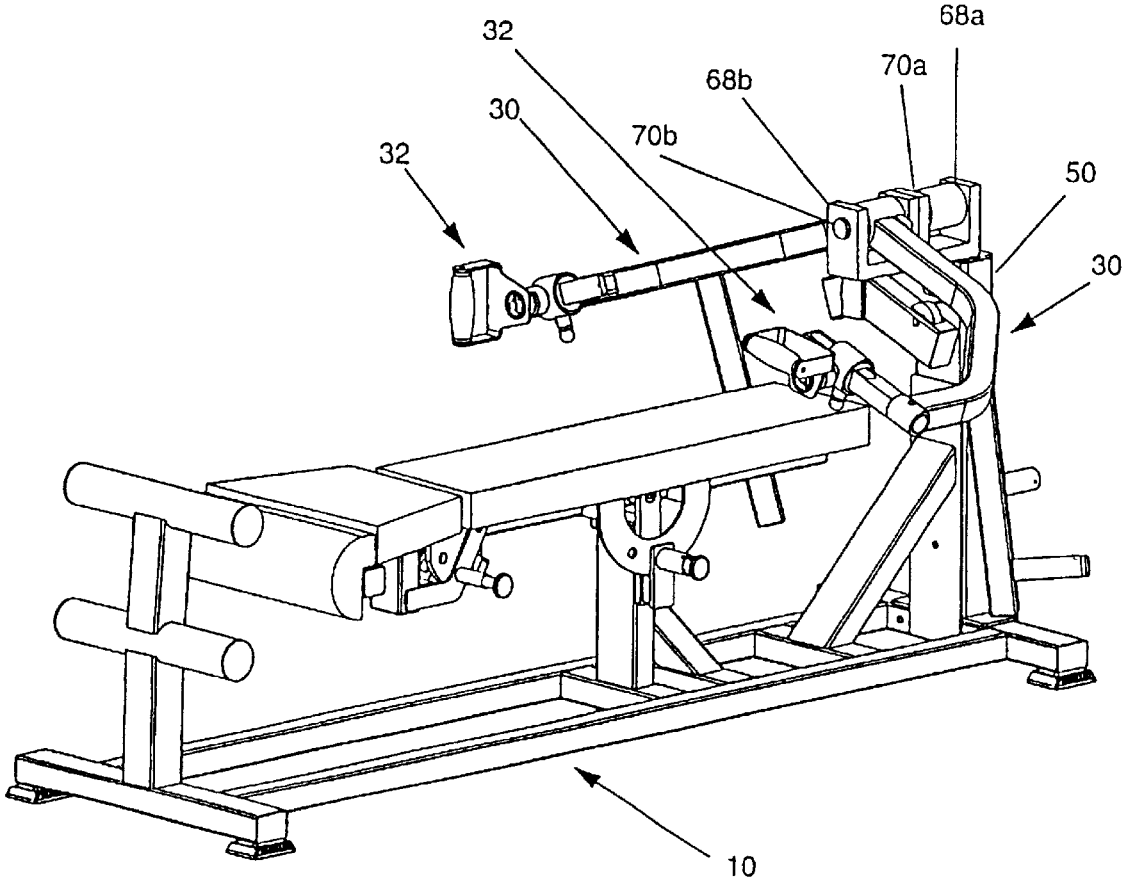
FIG. 13 is a perspective view of the exercise machine of FIG. 1 with parallel co-linear arm pivot axles.

FIG. 12 is a perspective view of the position of the two exercise arms for an alternative embodiment of the present invention with co-linear arm pivot axles. It shows two arm pivot axles 70*a*, 70*b* placed one in front of the other along the same axis line. In this embodiment of the present invention each arm pivot axle 70*a* and 70*b* is rotatably attached to an arm pivot axle attachment assembly 68*a* and 68*b*, fixedly attached to the vertical frame member 50 as shown in FIG. 13. In the preferred design shown in FIG. 1, arms 30 are not the same length, i.e., the longer arm is placed further back on axle 70 than the shorter arm thus keeping the handles 32 moving in the same plane (T–T') relative to one another. In the co-linear design axles 70*a* and 70*b* would therefore be in line but offset to keep the handles 32 moving in the same plane. In the alternative embodiment of the present invention, the arm pivot axle attachment assemblies 68*a* and 68*b* are attached to the vertical frame member 50 by welding.

Figure 14:
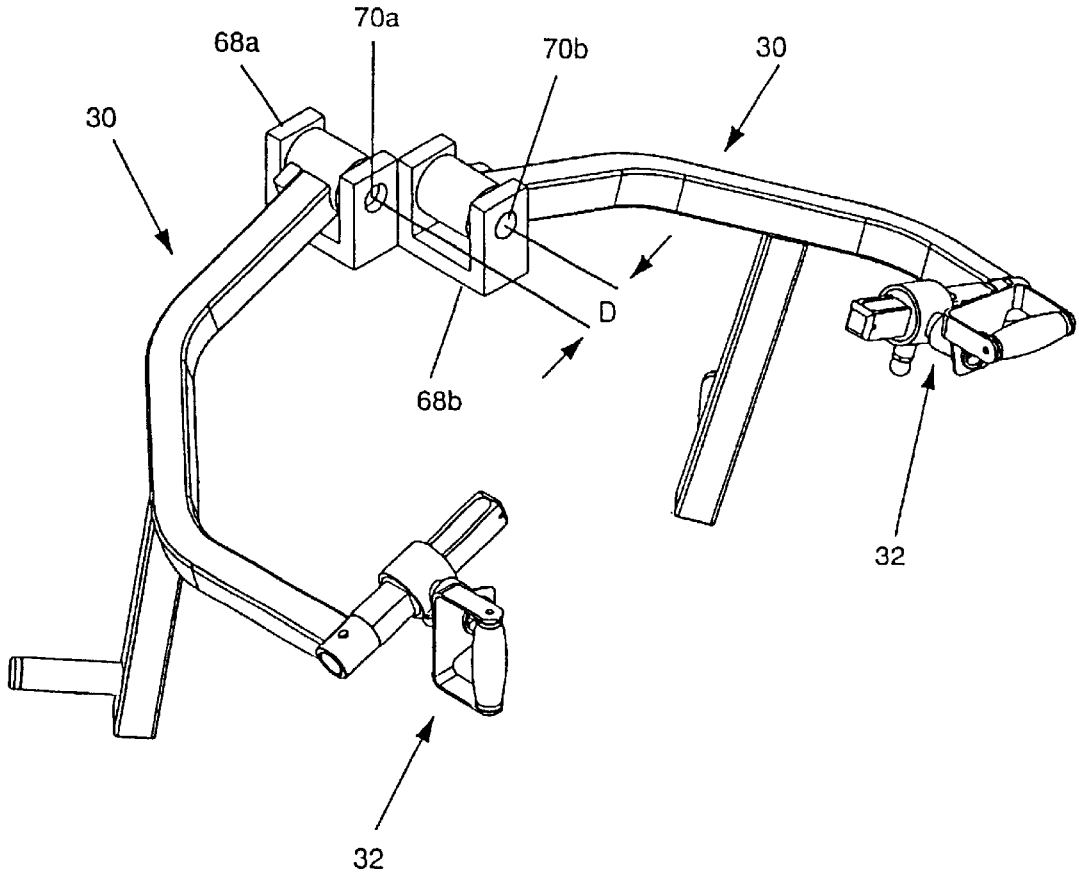
FIG. 14 is a perspective view of the position of two exercise arms for the embodiment of the present invention with co-planar arm pivot axles.
Figure 15:
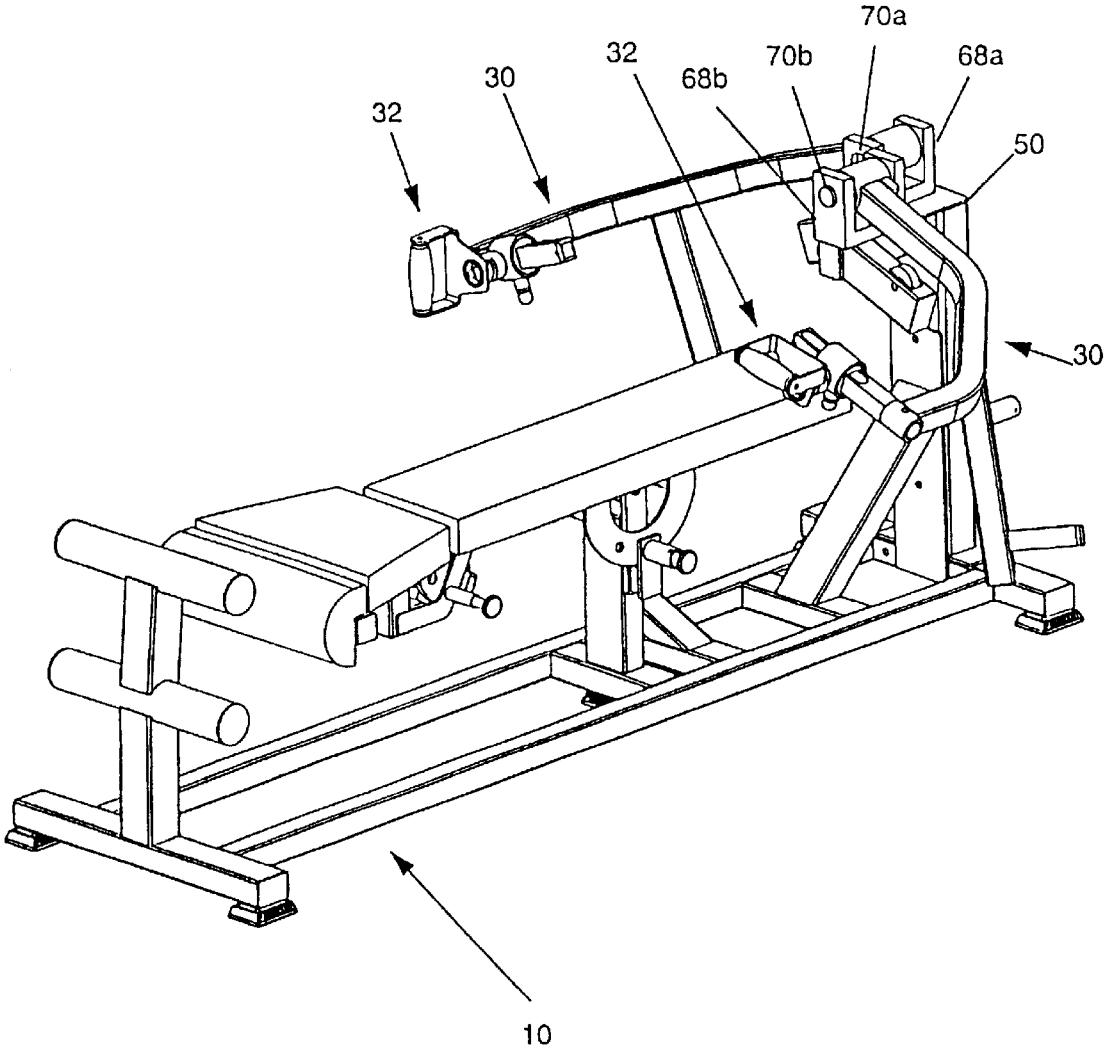
FIG. 15 is a perspective view of the exercise machine of FIG. 1 with parallel co-planar arm pivot axles.

FIG. 14 is an alternative embodiment of a perspective view of the exercise arms similar to those of FIG. 1 but with parallel co-planar arm pivot axles. In this embodiment of the present invention two arm pivot axles 70*a*, 70*b* are placed parallel with each other in the same plane and rotatably attached to an arm pivot axle attachment assembly 68*a* and 68*b*, fixedly attached to vertical frame member 50 as shown in FIG. 15 preferably by welding. As with the preferred design of FIG. 1, or the co-linear design of FIG. 13, the arms 30 are shown offset with respect to one another to keep the handles 32 moving in the same plane (T–T'). The offset dimension D shown in FIG. 14 and represented again in FIG. 16 should be minimized (ideally 0") thereby functionally approximating the preferred co-linear design of FIGS. 1 and 13.

Prior to getting into position on the exercise bench, the user places weight plates 52 onto weight posts 29 of arms 30 thereby setting the resistance for exercise. The user adjusts the seat pad assembly 90 to the desired seating position θ by pulling outward on pin 76, lifting pad assembly 90 to the desired position, releasing pin 76 into one of the engagement holes 86 of adjustment plate 85 shown in FIG. 10*b* and FIG. 11. The user then adjusts bench assembly 80 to the desired exercise angle by pulling outward on pin 74, pivoting bench assembly 80 to the desired angle γ, releasing pin 74 and engaging one of the adjustment holes 83 of arc 82 as shown in FIG. 10*a* and represented in FIGS. 8 and 9. The user adjusts the handle adjustment sleeves 44 along the adjustment bar 42 thereby determining the diameter of the movement arc for the exercise. The diameter of the movement arc is specific for the size of the user. A taller user will push the adjustment sleeves 44 further out from the center of the machine while a shorter person will place the adjustment sleeve assemblies 44 closer to the center of the machine. These adjustments will position the shoulder joints in the functional window. The exercise is then performed by pressing upward against the added resistance until the user's arms are out-stretched.

The handle assemblies 32 pivot about the wrist joint accommodating pivots 39, allowing the user's hand to pivot about the wrist joint, defining an arc that is determined by the length of the user's arms. The user's exercise movement on the exercise bench of the present invention is more refined, smooth and fluid because it is machine-determined and adjusted for the individual user.

As described above, exercise arms 30 swing upward in a machine-defined arc within plane T–T', about arm pivot axle 70 bringing the handle assemblies 32, pivoting on wrist joint accommodating pivots 39 together at the end of the exercise movement. This motion of arms 30 and handles 32 of the present invention allows the user to perform natural articulation of the shoulder, elbow and wrist joints. All embodiments of the exercise bench of the present invention, with a singular arm pivot axle, two co-linear arm pivot axles and two parallel co-planar arm pivot axles, have been further analyzed and data have been collected in order to determine the best position of the arm pivot axle(s) 70, 70*a*, 70*b*. Further, after the data has been obtained by empirical methods, an envelope encompassing all collected data has been defined by five functions in order to obtain the best fit encompassing all the collected data. The constants of the equations may vary slightly. Therefore, the results presented herein should not be considered as limitations but only as representations.

Figure 16:
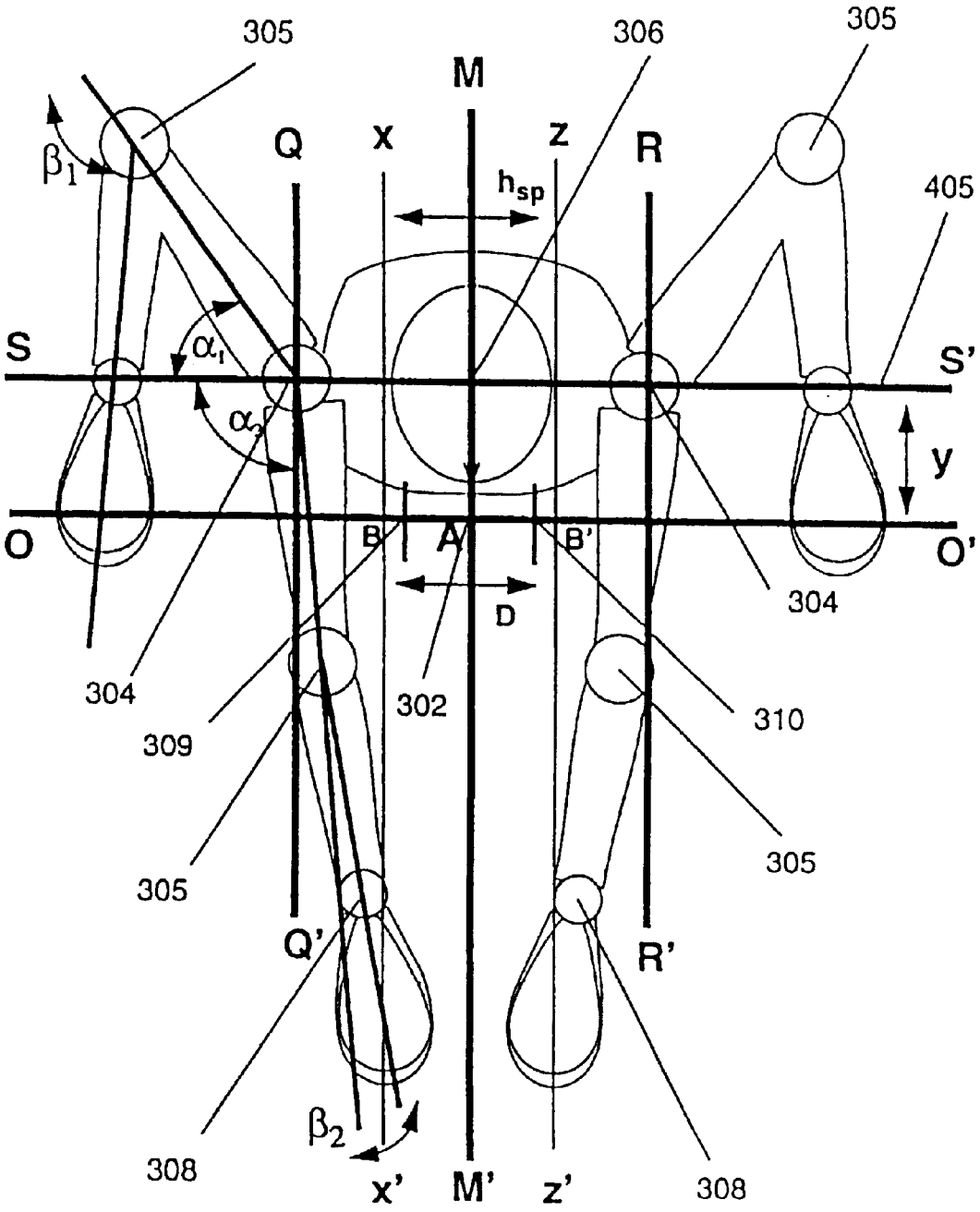
FIG. 16 is a top view illustration of the parameters of the user's arm movements, from the starting to the ending point of the exercise motion path, applicable to placement of the arm pivot axle relative to the user when in the supine press position.
Figure 17:
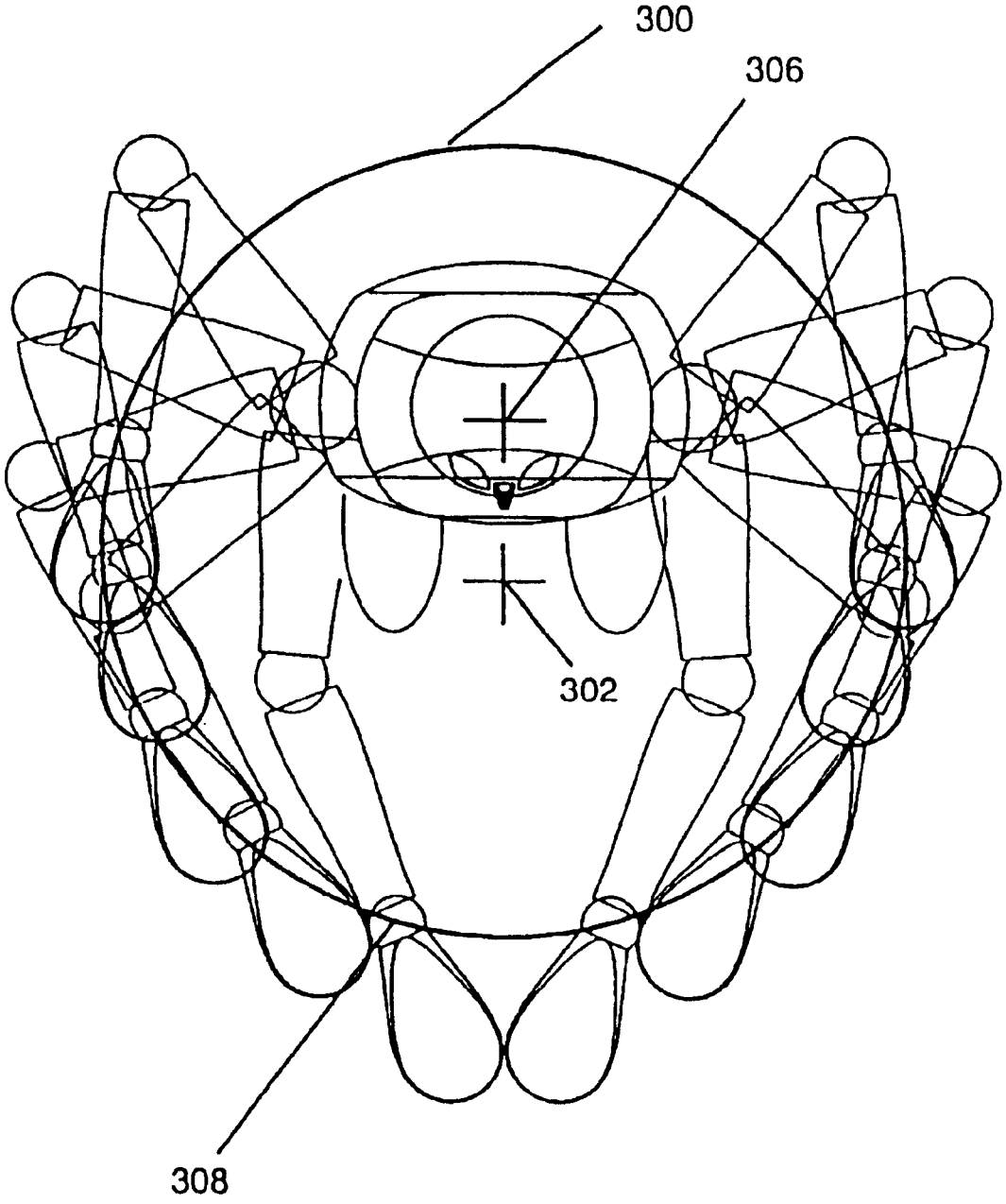
FIG. 17 is a top view illustration of the user's arm movements, from the starting to the ending point of the exercise motion path, applicable to the machine of the present invention in each of the three exercise positions.

FIG. 16 is an illustration of the parameters of the user's arm movements, from the starting to the ending point of the exercise motion path. FIG. 17 is an overhead view of a user, showing the desired beginning and ending articulation points and angles. The user's joints are identified by a shoulder joint 304, elbow joint 305, and a wrist joint 308. A plane passing through the center of both shoulder joints 304, coincident with axis 405, is defined as plane S–S'. For comfortable movement, the wrist joint 308 cannot pass to the backside of plane S–S'. A plane normal to the S–S' plane passing through the centerline of the body is defined as M–M' plane. Two additional planes X–X' and Z–Z', spaced apart by an offset $h_{sp}$, are used in FIG. 16 to show spacing between the adjustable handle assemblies 32. The planes X–X' and Z–Z' define the furthest forward position of the user's wrist joints 308 before the adjustable handle assemblies 32 collide. The distance of the planes X–X' and Z–Z' from the M–M' plane is 6 inches (3 inches to each side of the plane M–M'). The offset plane O–O' for the arm pivot axles 70, 70*a*, 70*b* is offset from the plane S–S' by the displacement γ. The planes Q–Q' and R–R' pass through each user's shoulder joint 304, respectively, and are normal to the plane S–S'.

For complete natural articulation, the user's wrist joint 308 should end between the planes Q–Q' and R–R' at the end of the full exercise but not cross plane M–M'. The location of the singular arm pivot axle 70 is designated as point A, 302. The locations of two arm pivot axles 70*a*, 70*b* are designated as B 309 and B' 310, and are spaced apart by an offset D (each pivot B, B' is offset by D/2 to each side of the plane M–M'). The offset D will vary from zero, for a singular axle machine, to a maximum value determined by the displacement γ (see below).

In FIG. 16, the amount of the user's shoulder flexion at the beginning of the movement is defined by angle $\alpha_1$. The amount of user's shoulder extension at the end of the movement is defined by $\alpha_2$. The total amount of user's shoulder articulation is, therefore, $\alpha_1+\alpha_2$. User's elbow flexion is defined by angles $\beta_1$ and $\beta_2$.

For natural articulation, the beginning flexion angle $\alpha_1$ for the shoulder joint 304 is between 30 and 55 degrees. The ending extension angle $\alpha_2$ of the user's shoulder joint is between 80 and 95 degrees, and the optimum ending extension angle $\alpha_2$ is 85 degrees. The beginning elbow flexion angle $\beta_1$ is between 100 and 130 degrees, and optimally 120 degrees. At the ending point of the motion, the ending elbow flexion angle $\beta_2$ is between 5 and 25 degrees and optimally 10 degrees.

For the values of the displacement γ above and offset D below, the wrist joint 308 could not pass behind plane S–S' when the angles $\beta_1$ and $\alpha_1$ are limited to their initial position range. Likewise, the wrist joint 308 could not pass planes X–X' and Z–Z' or fall-to the outside of planes Q–Q' and R–R' when the angles $\beta_2$ and $\alpha_2$ are set within their ranges for the ending articulation.

The optimum position for a singular arm pivot axle A 302, when D=0, is at the displacement $\gamma$=5.625 inches. The usable range of values for the displacement $\gamma$ and offset D is an envelope region bordered by straight line functions placed at the offsets D=0 and D=9.8 inches, and the following three functions for $\gamma$ relative to the offset D:

$$T_D=6.4-1.58^{-7.0/5D^2+1.5D+1.5}-0.09D$$

$$f_D=4.68-1.85^{-1.15/0.5D^2+0.25D+1.75}$$

and $$g_D=3.7+0.0008D^{2.5}-0.0006D^2-0.0095D$$

The functions $_{TD}$, $f_D$, and $g_D$ define the lateral displacement $\gamma$ above in relation to the offset D and provide a good fit to the collected data. The function $T_D$ is the top border of the envelope region. The function $f_D$ represents one part of the bottom border of the envelope region from D=0 to D=6. The function $g_D$ represents the other part of the bottom border of the envelope region, from D=6 to D=9.8.

The exercise movement can be done unilaterally, one exercise arm 30 pivoting at a time, so the movement of one exercise arm 30 is independent and does not cause a corresponding movement of the other exercise arm 30. Thus, the user can exercise the left and the right side of the body independently, in which case the handgrip 36 of the exercise arm 30 can be moved beyond the centerline of the body while the other exercise arm 30 is kept at the rest position. This feature is important for sports activities that benefit from unilateral training such as swimming or in injury rehabilitation.

In all of the positions of the exercise bench of the present invention, the arc of the machine-determined circular exercise motion path is coincident with the movement of the wrist joint accommodating pivot 39 from start to finish of an exercise. FIG. 17 shows a circular arc 300 that illustrates the exercise arm 30 movement on the exercise bench of the present invention, which coincides with the movement of the wrist joint accommodating pivot 39 from start to finish of an exercise. The center 302 of the circle corresponding to the exercise path arc 300, which defines the position of the arm pivot axle 70, is located in a plane parallel to the plane positioned through the user's shoulder joints (when the user is in the supine press position) and at a lateral displacement $\gamma$ from it, marked in FIG. 19 as the displacement $\gamma$, and at a location further into the exercise stroke than the parallel plane, defined above.

In the exercise bench of the present invention, the handgrip stirrup 34 is offset forward of the wrist joint accommodating pivot 39, and the wrist joint accommodating pivot 39 is located substantially in line with the user's wrist joint 308, for rotation of the user's wrist joint 308 about the wrist joint accommodating pivot 39. Therefore, each user's hand is allowed to move freely and separately relative to the other user's hand, and allowing user's hand to move in a non-circular motion path, whereby the user's hands may describe asymmetric arcs, since they can rotate about the corresponding wrist joint accommodating pivot 39.

Figure 19:
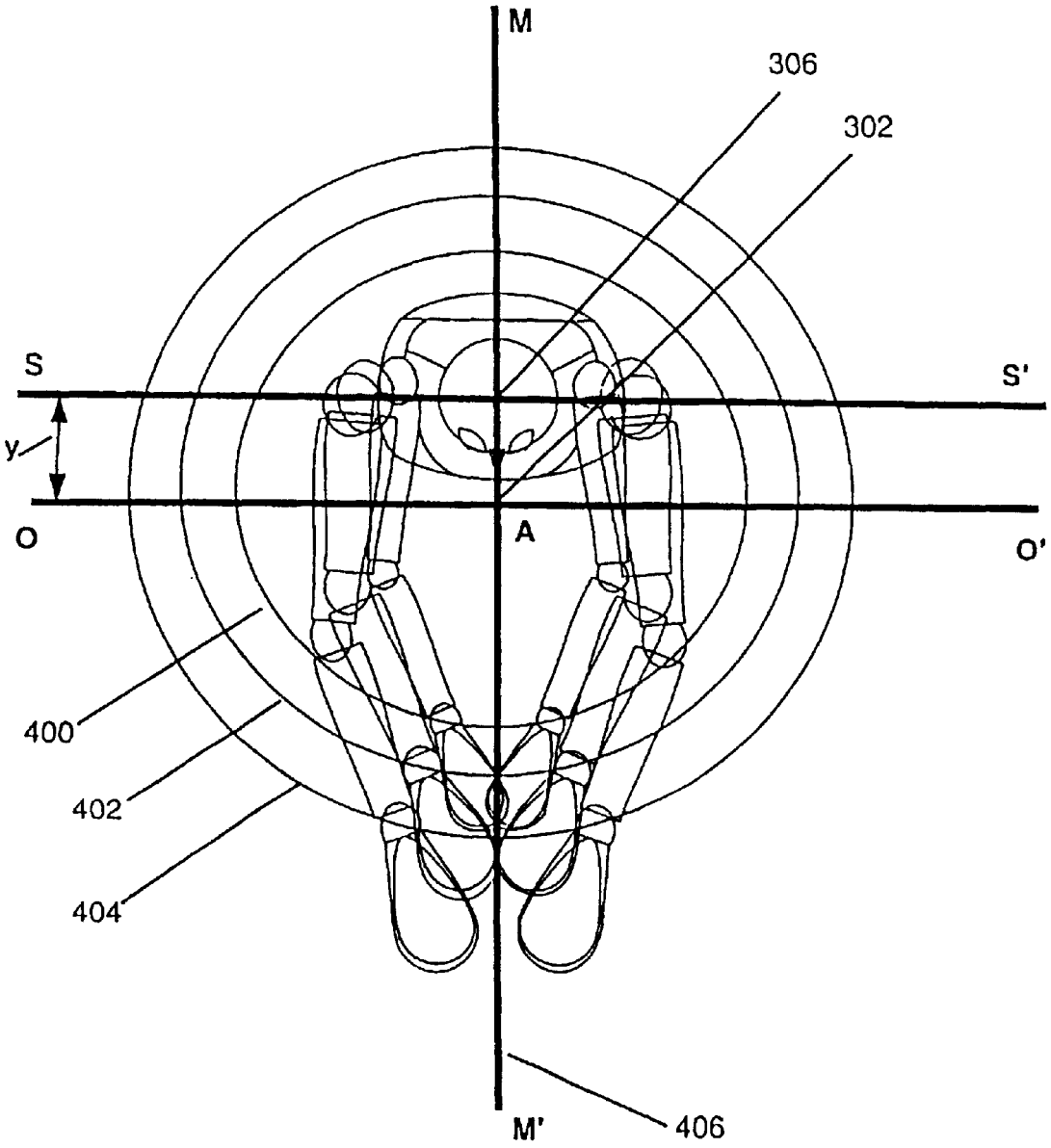
FIG. 19 shows a compilation of the arm movements of a full spectrum of male and female users, represented with an arc defined by the arm movement of the 5th percentile female, an arc defined by the arm movement of the 50th percentile male and an arc defined by the arm movement of the 95th percentile male, applicable to the machine of the present invention in each of the three exercise positions.

FIG. 19 shows a compilation of the arm movements of a full spectrum of male and female users, using the exercise bench of the present invention in any of its intended positions, represented with an arc 400 made by the 5th percentile female, an arc 402 made by the 50th percentile male and an arc 404 made by the 95th percentile male, all having the same center point 302 coincident with arm pivot axle 70 of the machine. FIG. 19 illustrates that all users finish at the same ending articulation shown by the close finishing proximity to plane 406.

When extended, these arcs 400, 402, 404 create three concentric circles, and the diameters range from 26 to 38 inches. The displacement $\gamma$ ranges between 4 and 6¼ inches and preferably 5.625 inches, as mentioned above, and corresponds to the center of the exercise path arc 302. The arcs 400, 402, 404 coincide with the movement of the wrist joint accommodating pivot 39 from start to finish of an exercise.

The exercise bench of the present invention in all of the intended positions provides articulation of the joints of the upper torso and arms through natural ergonomic exercise motion paths. User's shoulder, elbow, and wrist joints are taken through their complete ranges of motion, during the course of the three chest press exercise movements, without wrist or other joint impingement, thus decreasing the stress in the joints and keeping the proper muscle balance, which is not possible in conventional machines but only with free-weight dumbbells. The user's exercise movement on the exercise bench of the present invention is more refined, smooth and fluid, because it is machine-determined and adjusted for the individual user, giving the training associated, and previously only available, with free-weight dumbbells for advanced users.

The present invention provides an exercise bench functional in varying degrees of inclination that can be used by men and women of differing skill levels, body size and structure, to give them the same joint articulation and same training benefits, in a safe and reliable manner, and provide optimum exercise results for a wider range of users than presently available machines.

Figure 20:
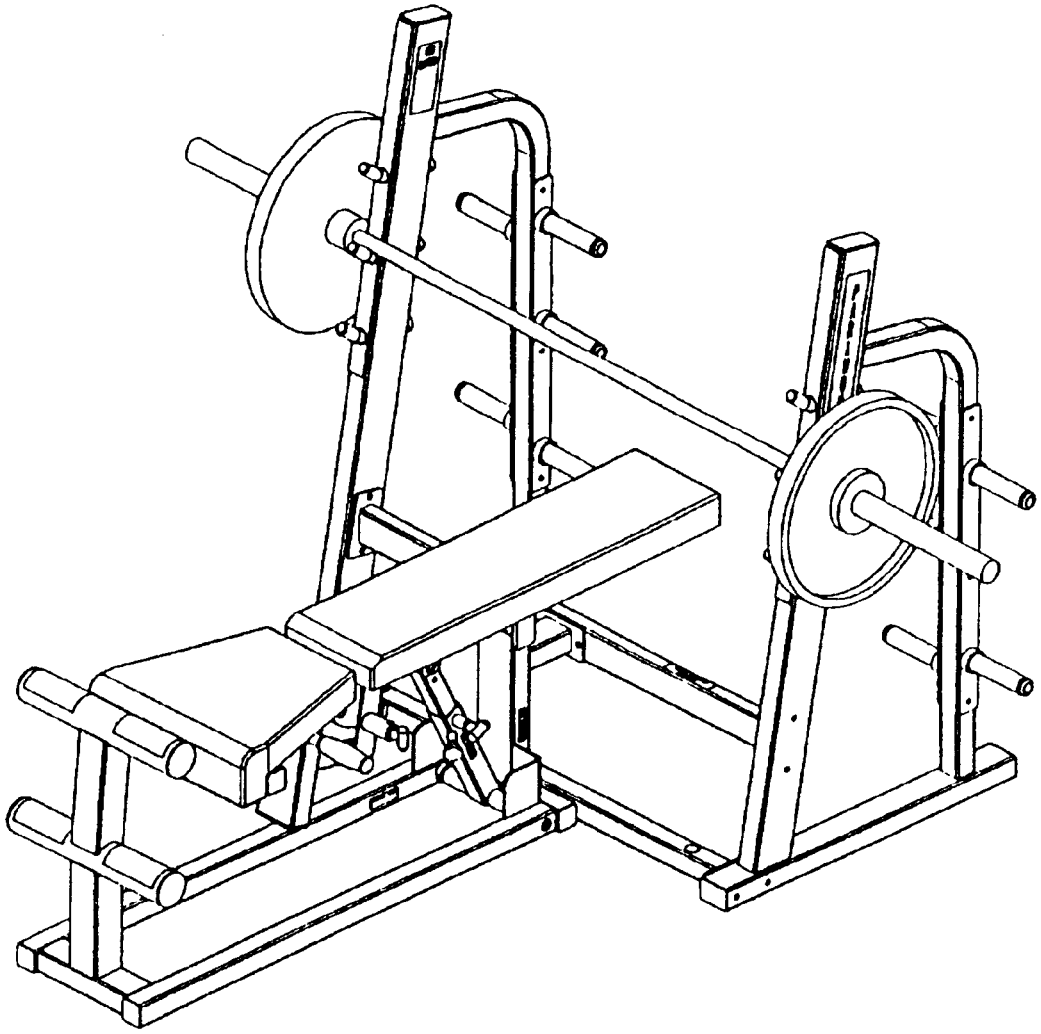
FIG. 20 shows one embodiment of the present invention adapted for use with a standard olympic bar, the exercising machine having a retractable support member coupled to a support frame for adjusting the angle of a bench assembly.
Figure 21:
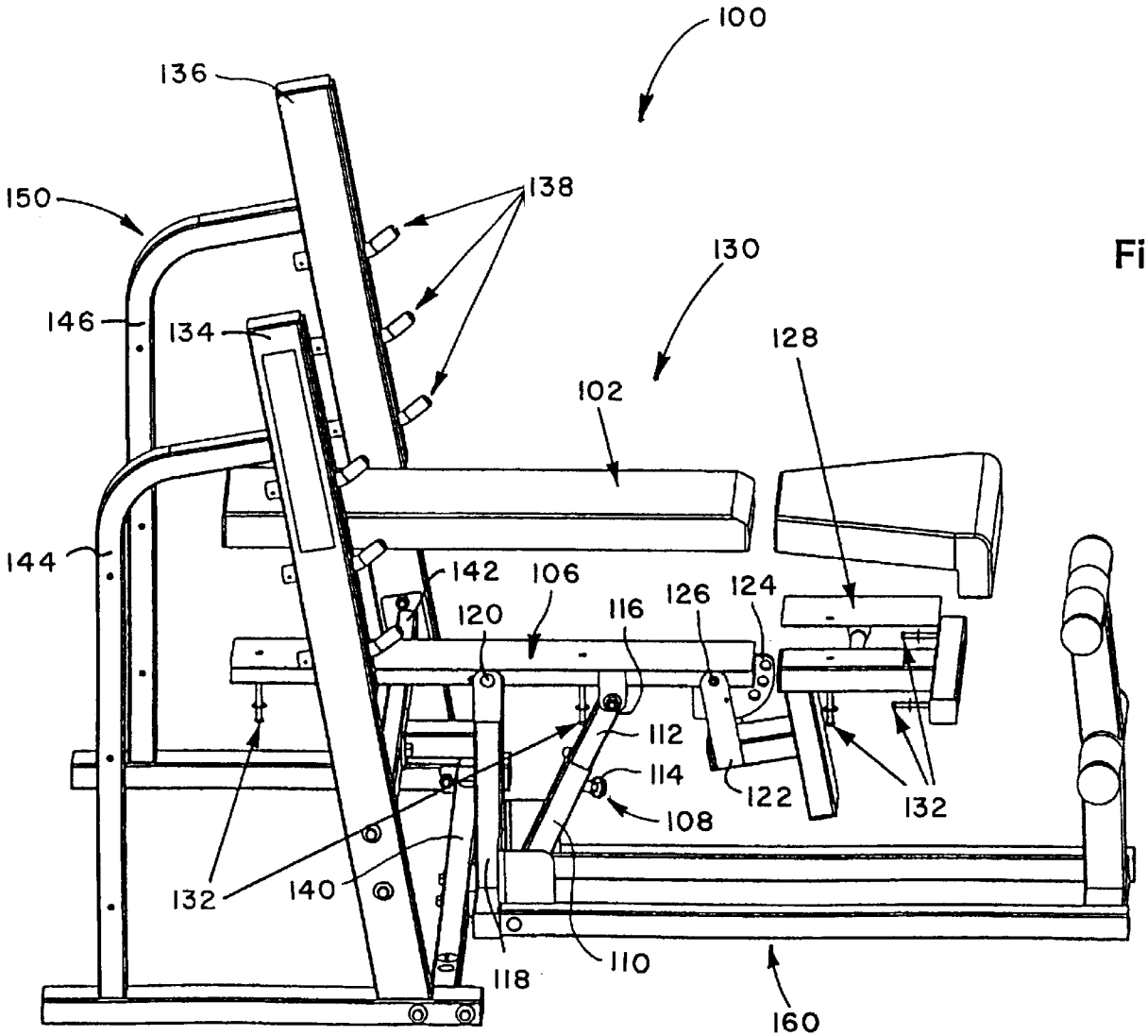
FIG. 21 shows a perspective view of the components of the machine of FIG. 20.
Figure 22A:
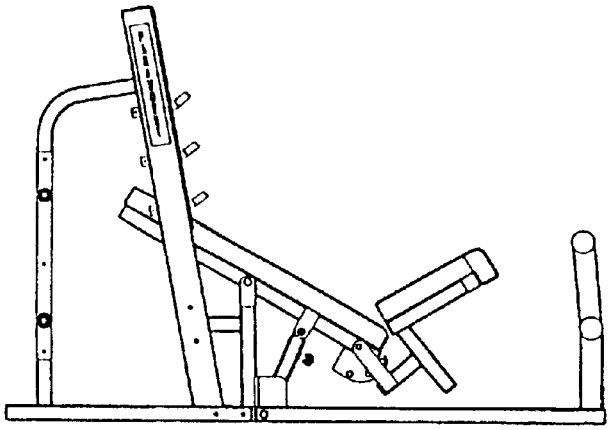
FIGS. 22*a*, 22*b* and 22*c* show the machine of FIG. 20 in each of three chest press positions.
Figure 22B:
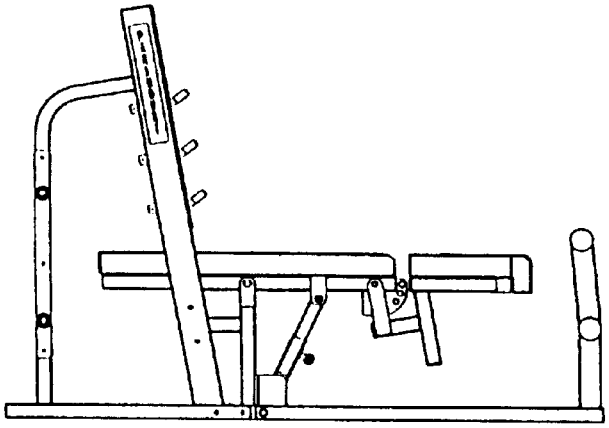
Figure 22C:
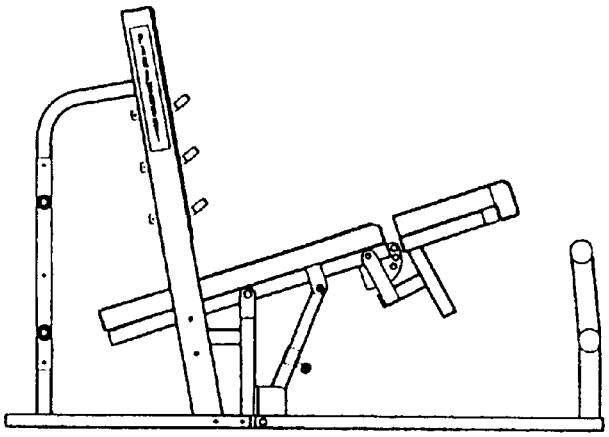

FIGS. 20 and 21 show another alternative embodiment of the invention. In FIG. 21, an exercise machine 100 comprises a bench assembly 130 coupled to an olympic bar support frame 150. The bench assembly 130 includes a bench pad 102 coupled to a bench frame 106 by two fastening means, such as screws 132. The bench frame 106 is pivotally coupled to a first support member 118 of a bench support frame 160 by a first bench axle 120, and is further coupled to the bench support frame 160 by a second support member 108. The second support member 108 includes a first tube 110 receiving a second tube 112 wherein the second tube 112 is retractable to determine the overall length of the second support member 108. A first distal end of the second support tube 112 is fixedly coupled to the bench frame 106 by a second bench axle 116. The first and second support tubes 110 and 112 are preferably of square tube shape wherein the second support tube 112 may be retracted within the first support tube 110. A fastening means 114 is also provided to lock the second support tube 112 against the first support tube 110 for determining the amount of retraction of the second support tube 112, and thereby the overall length of the second support member 108. As a result, by adjusting the overall retraction of the second support tube 112 within first support tube 110, a user may adjust the angle of the bench assembly 130 to either decline, supine, or incline positions (FIG. 22). Furthermore, this alternative embodiment of bench assembly 130 may also be adopted to replace the bench assembly 80 previously disclosed in the convergent exercise machines as shown in FIGS. 1, 13 or 14.

The bench assembly 130 may further include a seat assembly which is pivotally coupled to the bench frame 106.

Since the seat assembly of this alternative embodiment is substantially similar to the seat assemblies disclosed in FIG. 1, we do not need to describe it in any detail here.

The exercise machine 100 also includes an olympic bar support frame 150 coupled to the bench support frame 160. The olympic bar support frame 150 comprises left and right support arms 134, 136 coupled to each other by at least one connecting member in between. In FIG. 21, two connecting members 140, 142 are shown wherein both the connecting members 140 and 142 are substantially perpendicular to the bench frame 106. Each of the support arms 134 or 136 respectively comprise a plurality of catch posts, preferably three, for supporting and receiving olympic bar.

In another alternative embodiment, the bench assembly 80, as disclosed in FIG. 1, may be used in conjunction with the weight support frame 150. Thus, rather than adjusting the retractable length of a support member as above-mentioned, the user may adjust the angle of the bench assembly 80 by inserting the pin 74 into one of the adjustment holes 83 of the adjustment plate 82.

Figure 23:
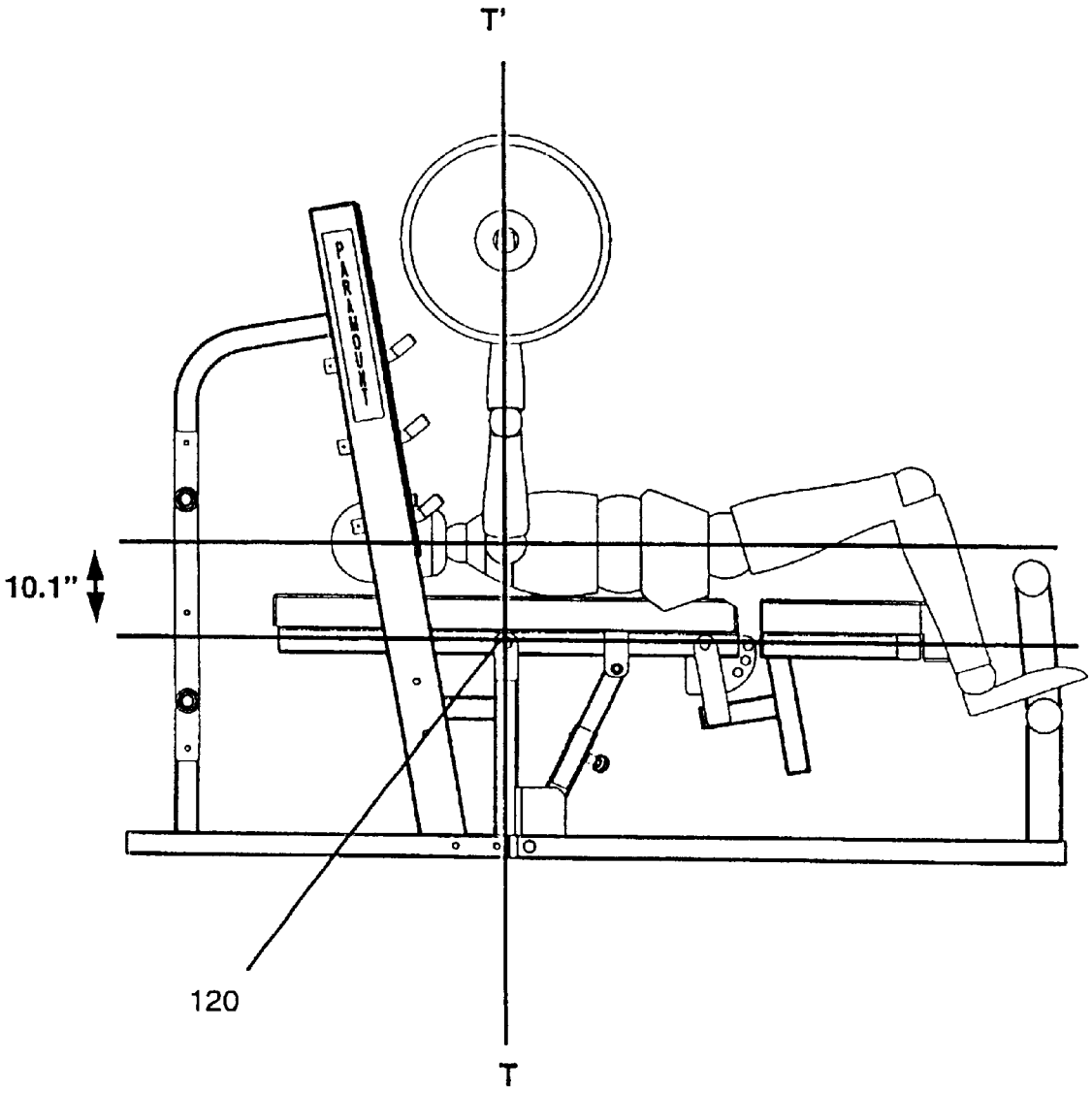
FIG. 23 shows the machine of FIG. 20 with a user performing a supine chest press, illustrating the alignment of the user's arms and shoulders with the bench pivot axis.
Figure 24:
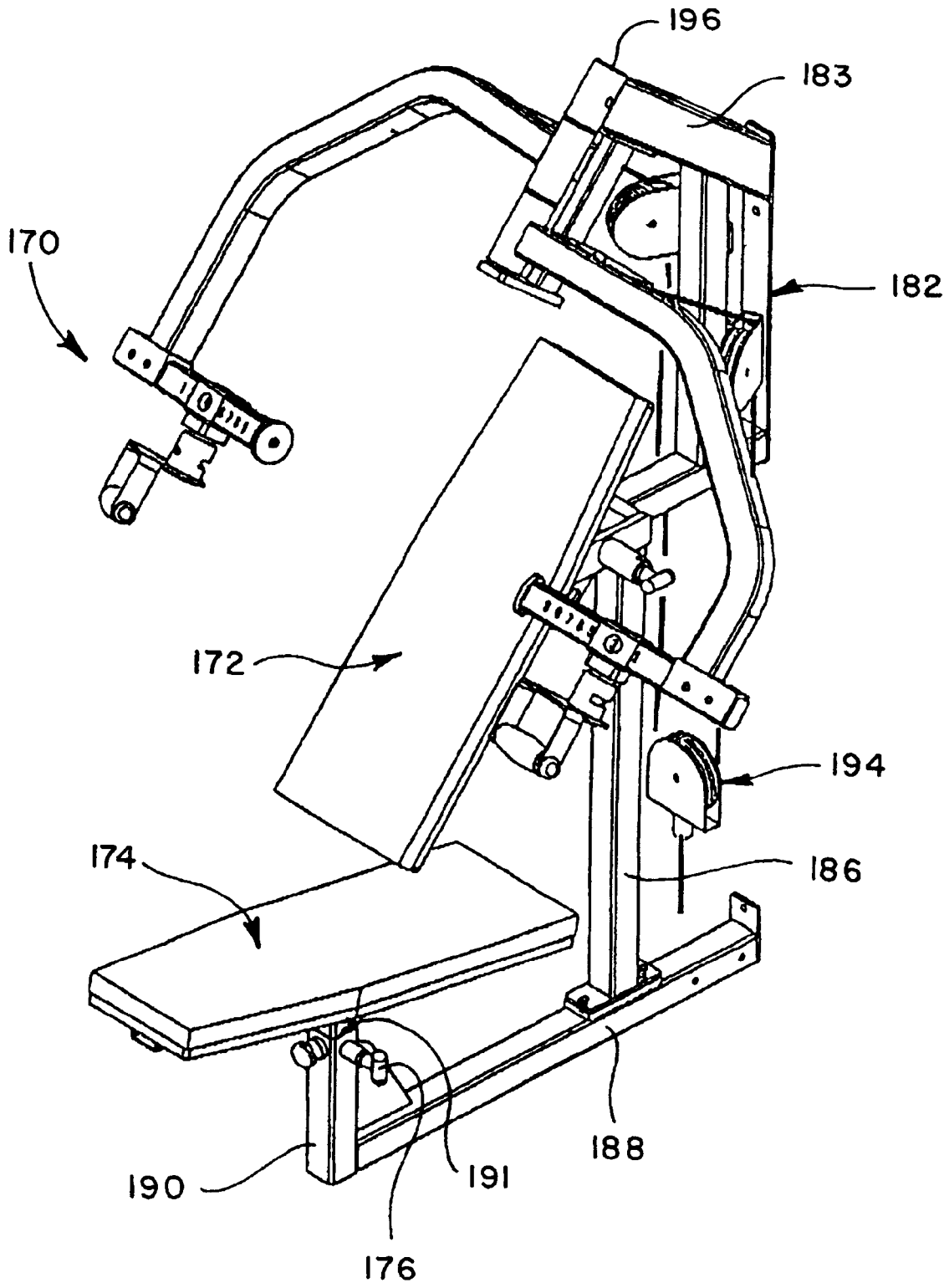
FIG. 24 shows a front perspective view of another embodiment of the present invention.
Figure 25:
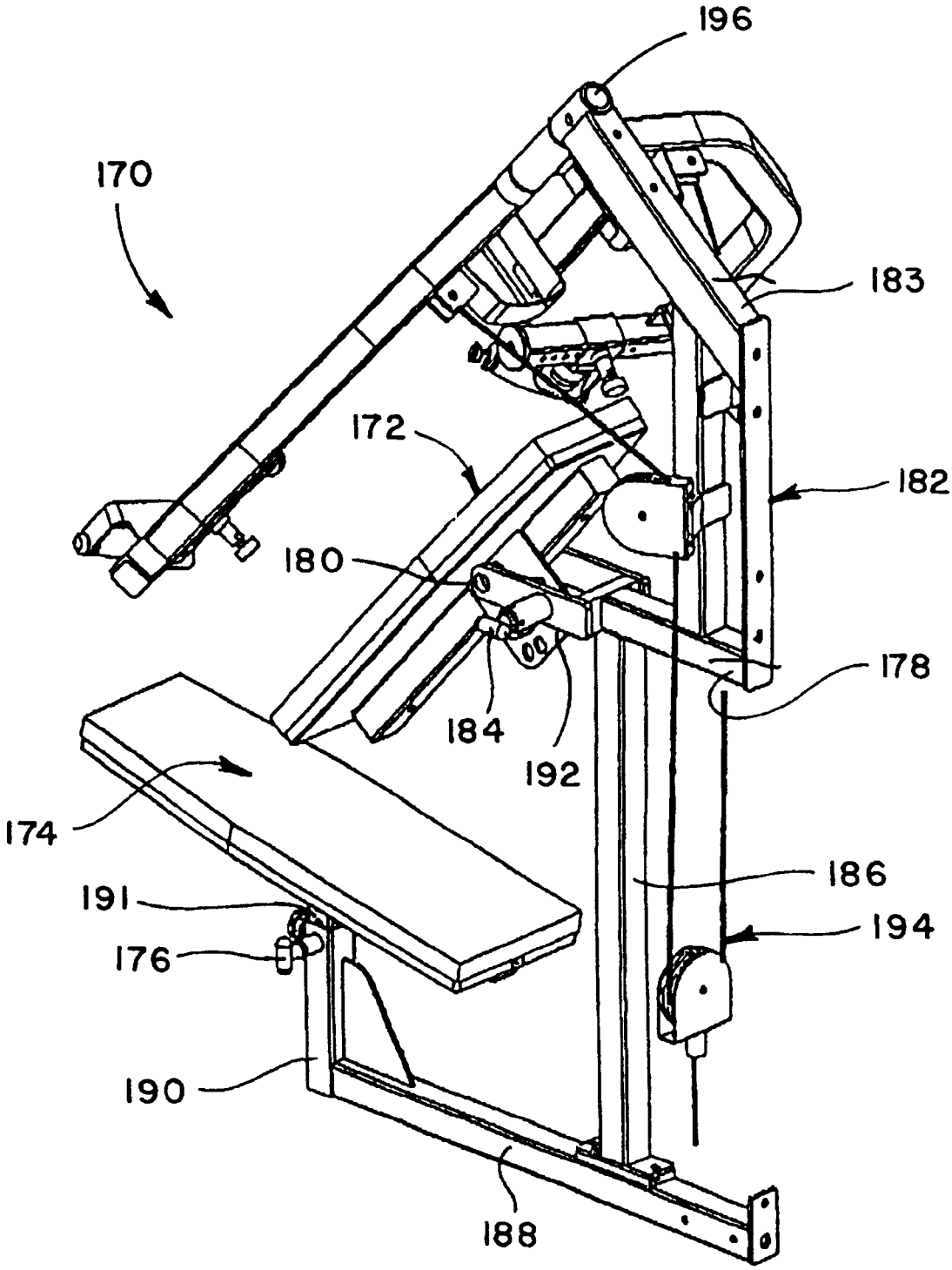
FIG. 25 shows a rear perspective view of the embodiment in FIG. 24.

As illustrated in FIG. 23, the user assumes the same relative body position as shown and discussed previously for FIGS. 7*a*, 7*b*, and 7*c*. This is due to the inclusion in this design the bench frame assembly 122 (FIG. 21) which is attached and adjusted in the same manner as frame 95 in FIGS. 1, 10 and 11. All three bench positions illustrated in FIGS. 22*a*, 22*b* and 22*c* place the user with the arms substantially vertical as illustrated in FIGS. 7*a*, 7*b*, and 7*c*.

In yet another embodiment of an exercise machine 170, as shown in FIGS. 24, 25, 26 and 27, the bench assembly and the seat assembly may be separately coupled to a support frame of an exercise machine. In particular, a bench assembly 172 is pivotally coupled to a horizontal support member 178 of a support frame 182 by a bench pivot axle 180. The horizontal support member 178 is further perpendicularly coupled to a first vertical support member 186 of the support frame 182 and to a main support member (not shown). In addition, a seat assembly 174 is coupled to a second vertical member 190 of the support frame at a distal end. The bench assembly 172 comprises an adjustment plate 192 having a plurality of adjustment holes. The adjustment holes are adapted to receiving pin 184 for adjusting angles of the bench assembly 172.

Figure 27:
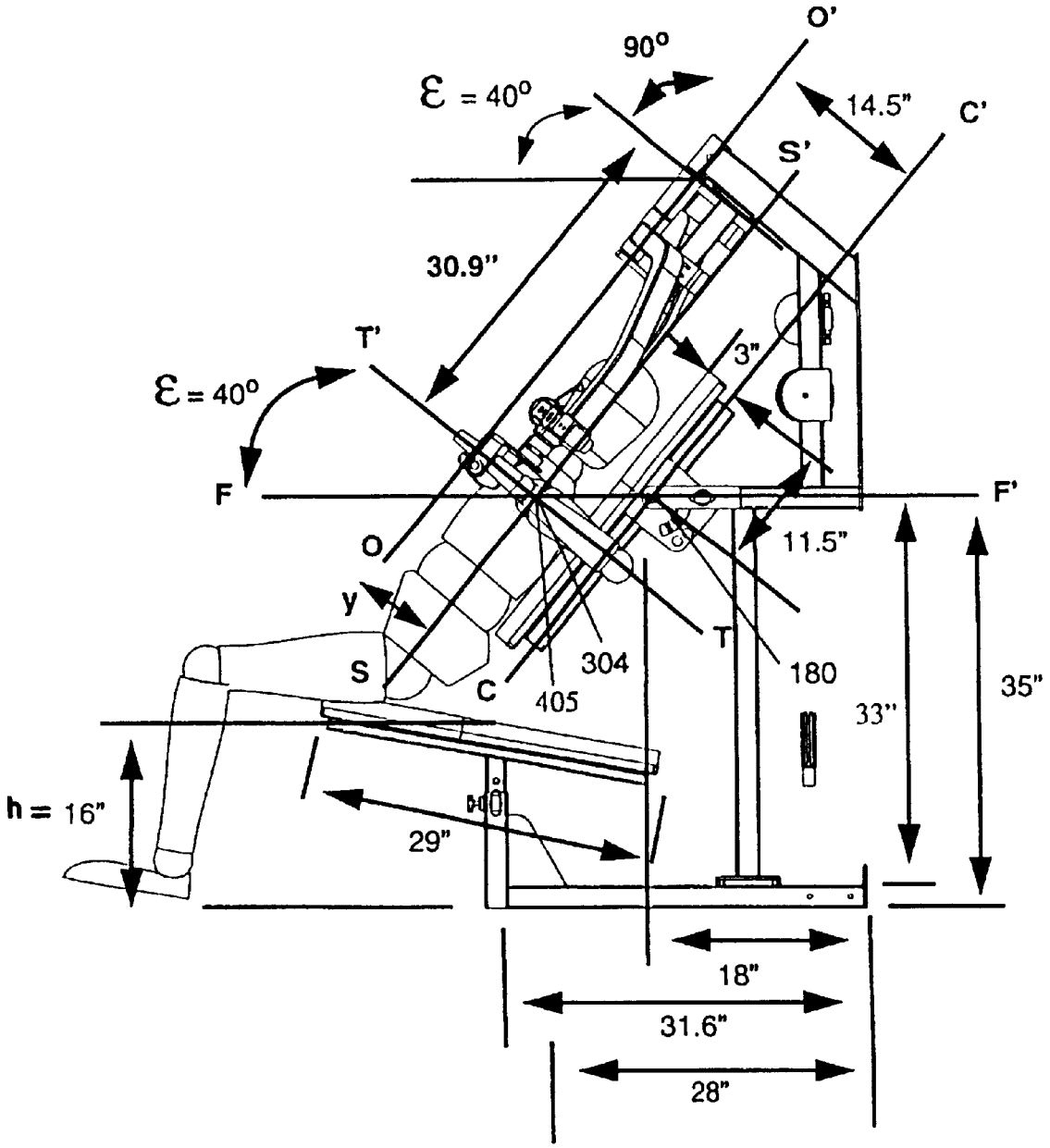
FIG. 27 shows the machine of the embodiment of FIG. 24 with the user in the supine chest position illustrating relative dimensions introduced in FIG. 18.

The seat assembly 174 is preferably fixed in a decline position of between 5° and 20°, preferably 10°. Further, the height of seat assembly 174 may be varied over a range of 4" to 8", preferably 6", by inserting pin 176 into one of a plurality of holes in member 191 of seat assembly 174. The optimum mid range height of the center of seat assembly 174 from the floor ranges between 14" to 18" preferably 16", as shown in FIG. 27. This would be the height used by an average 5'10" male user. The preferred length of the seat pad of seat assembly 174 is 29" with a pad of 25" to 32" working as well. The declination and length of seat assembly 174 allows the user to select one seat height for all exercises and then move along the seat pad dependent on the bench assembly angle γ' while maintaining the desired shoulder joint 304 orientation.

Figure 26A:
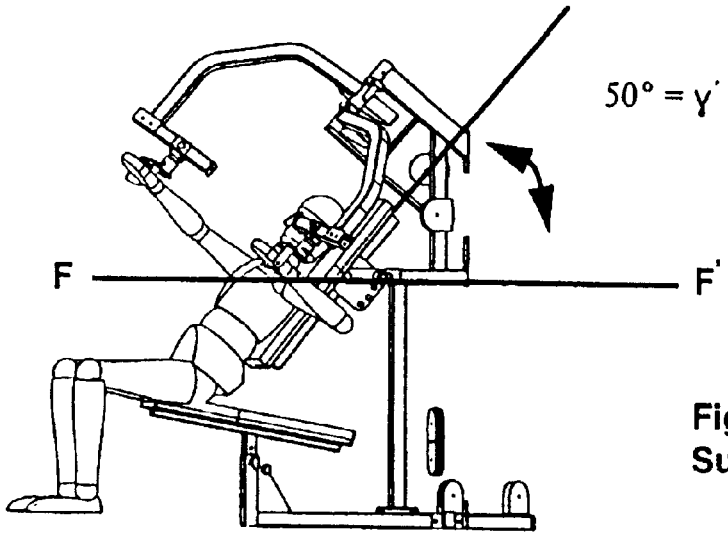
FIGS. 26*a*, 26*b* and 26*c* show the three exercise positions of the embodiment in FIG. 24 illustrating the arm and shoulder angulation.
Figure 26B:
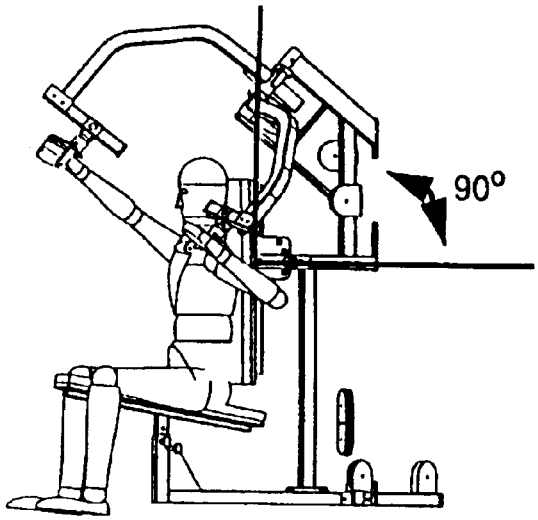
Figure 26C:
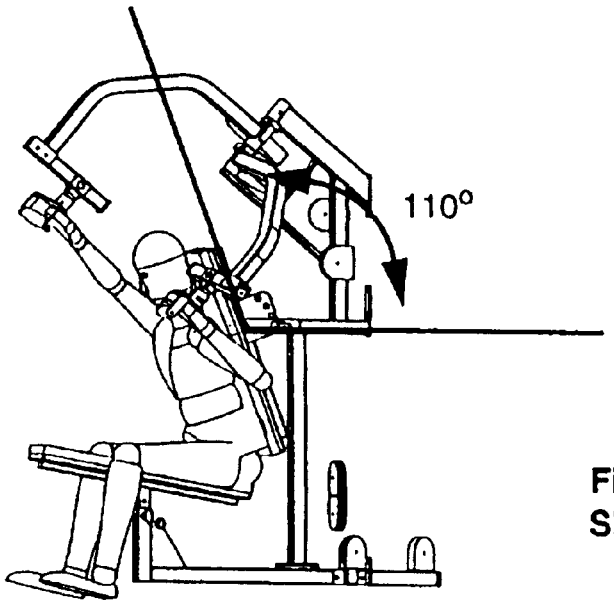

As shown in FIGS. 26 and 27, the preferred angles for bench assembly 172 are 30° to 60°, preferably 50°, for supine chest press, 70°–100°, preferably 90°, for incline chest press and 100° to 120°, preferably 110°, for shoulder press exercises. In all cases, the bench angle γ is taken relative to a horizontal plane.

Referring to FIG. 27, based on the above, the user's shoulder joints 304 should be placed along an axis 405 and the user's arm's and thus elbows 305 and wrists 308 should be restrained to articulate in a plane T–T'. With these constraints established, the user's body can then be placed in position for performing supine chest press, incline chest press or shoulder press exercises while maintaining the parallel nature of his/her arms within and along plane T–T' and his/her shoulders 304 in approximate alignment with shoulder joint axis 405. For structural integrity and stability, frame member 183 and arm pivot axle 196 (FIG. 25) must be rigid with their relative positioning to the rest of the bench components staying constant. The theoretical best case would be to place bench pivot axle 180 coincident with shoulder joint axis 405 thereby insuring proper alignment. This is not possible due to the very nature of the exercise and the body's positioning on the machine. Therefore, the placement of bench pivot axle 180 requires optimization based on the frame and pad construction to keep the user's shoulder joints 304 aligned closely with axis 405, while maintaining the user's arms moving in motion plane T–T'.

As generally shown in FIG. 27, the distance from pivot axle 180 to the top surface of bench assembly 172 is preferably 3". The placement of axle 180 is between 30" and 36", preferably 33", above frame 188, and forward of frame 182 by 16" to 20", preferably 18" as shown in FIG. 27. The placement of pivot axle 180 is such that at any bench angle γ' and for seat height h as determined by the user's height, the user's shoulder joints 304 will always be placed between 24" and 30", preferably 28", forward of frame 182 and between 30" and 36", preferably 33", above frame 188. As shown in FIG. 27, this corresponds to the user's shoulders 304 lying in a plane F'—F' passing through pivot axle 180.

Figure 28:
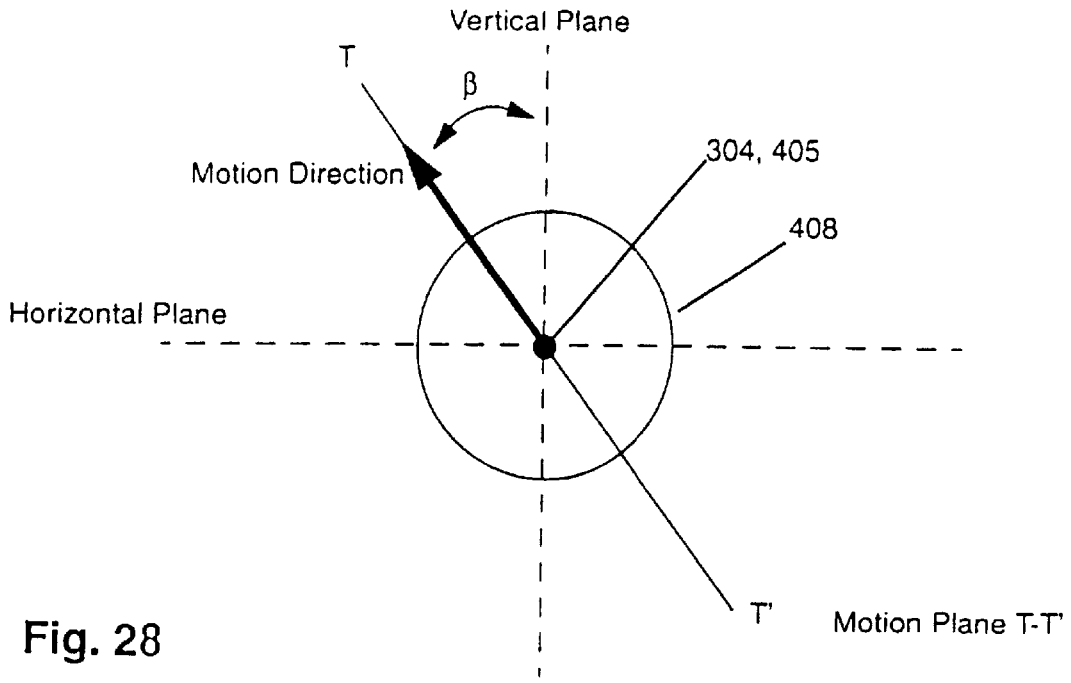
FIGS. 28–35, inclusive, illustrate schematically a method for determining an optimal bench pivot axle location in accordance with the present invention.
Figure 29:
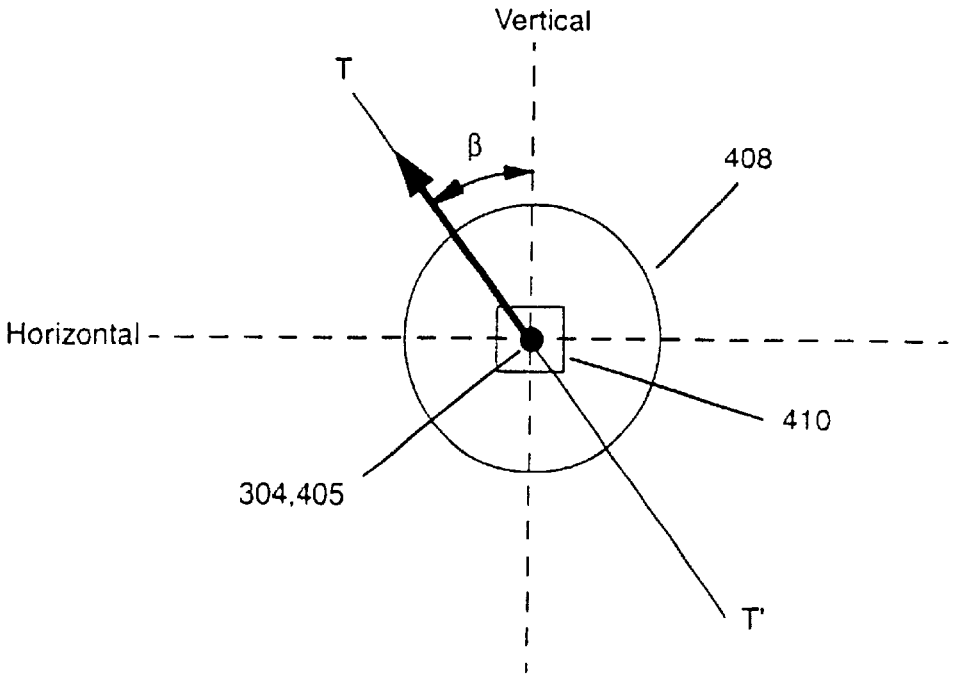
Figure 30:
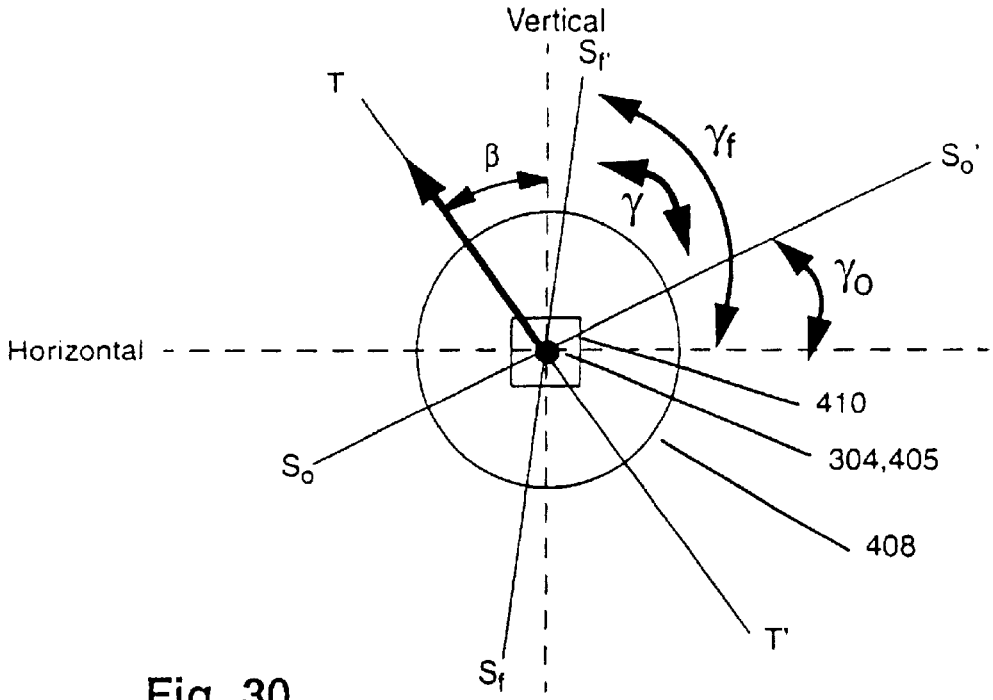
Figure 31:
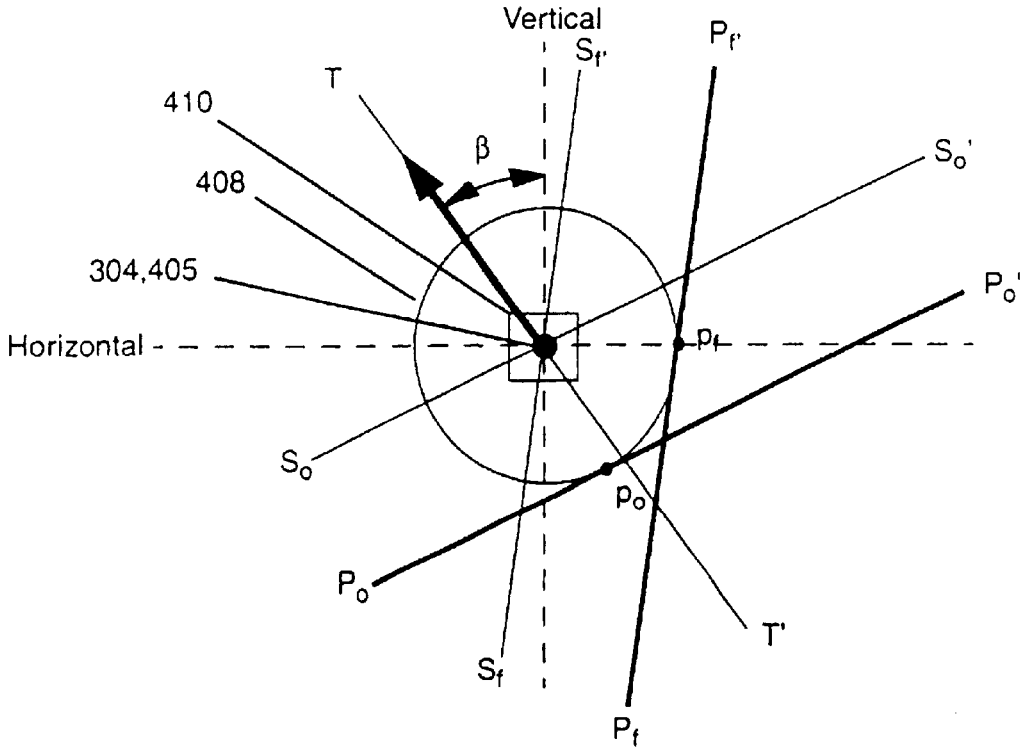
Figure 32:
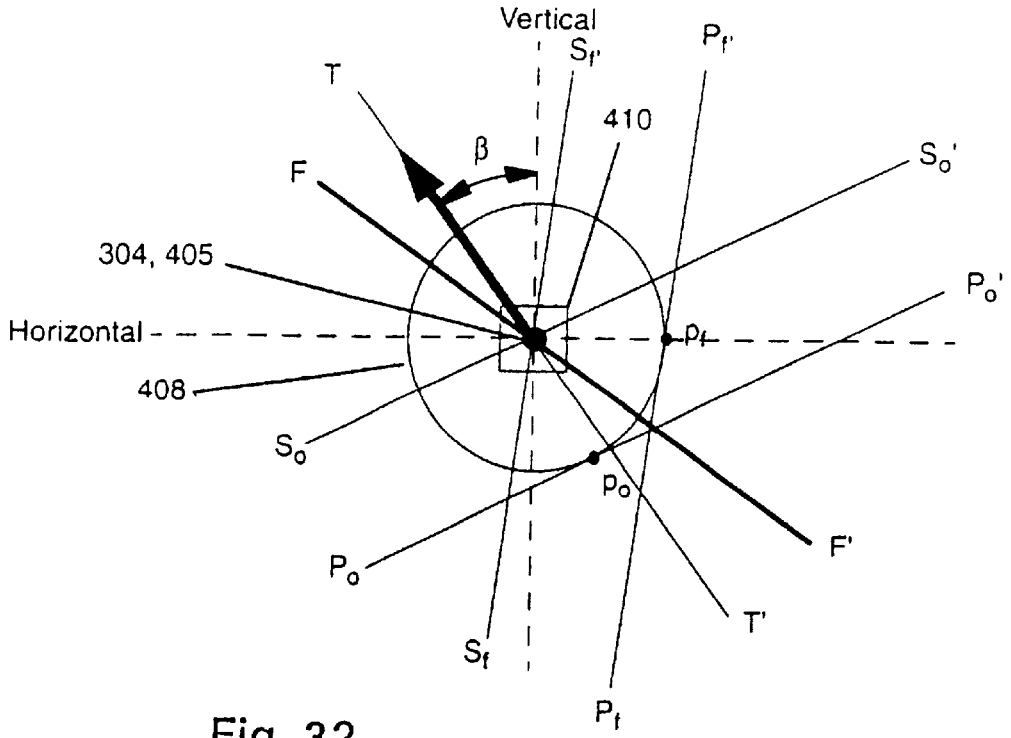
Figure 33:
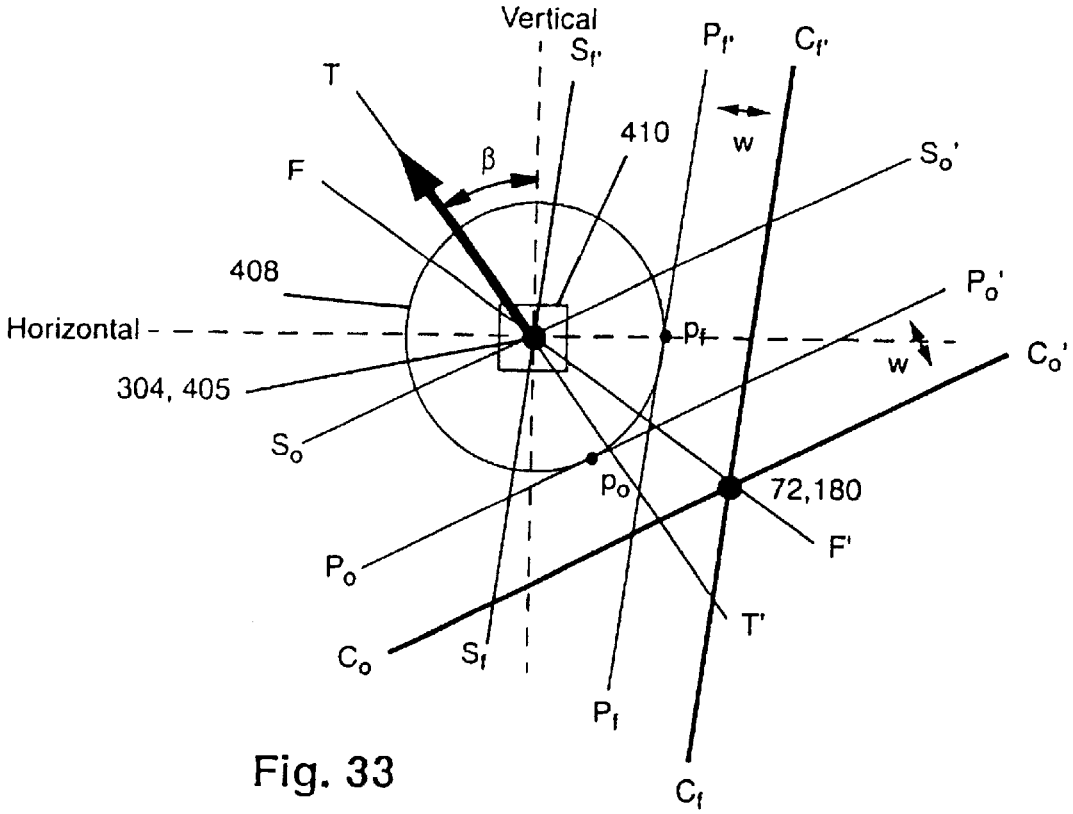
Figure 34:
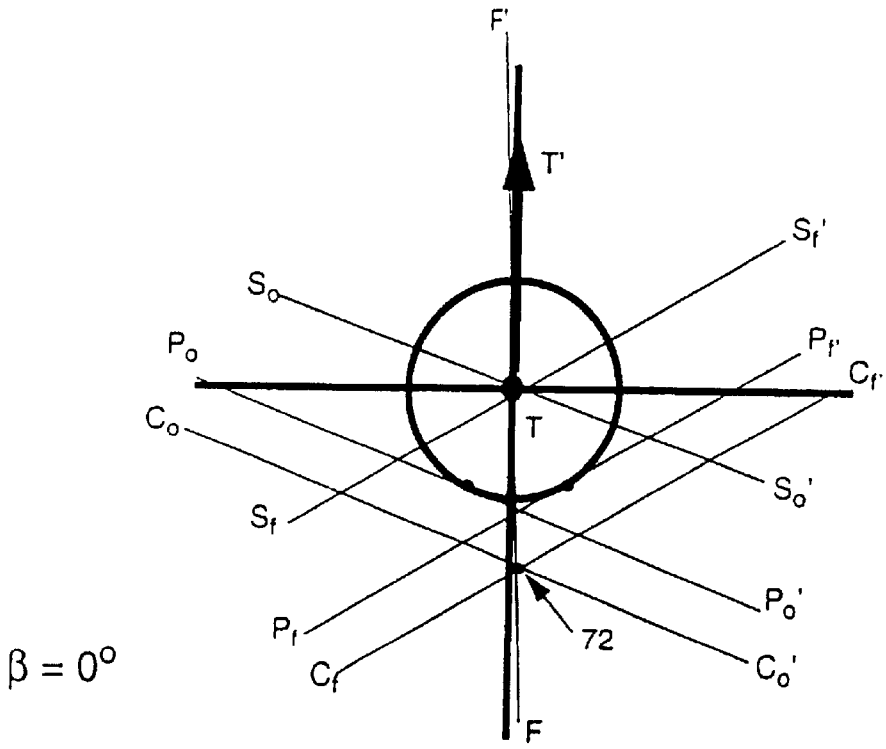
Figure 35:
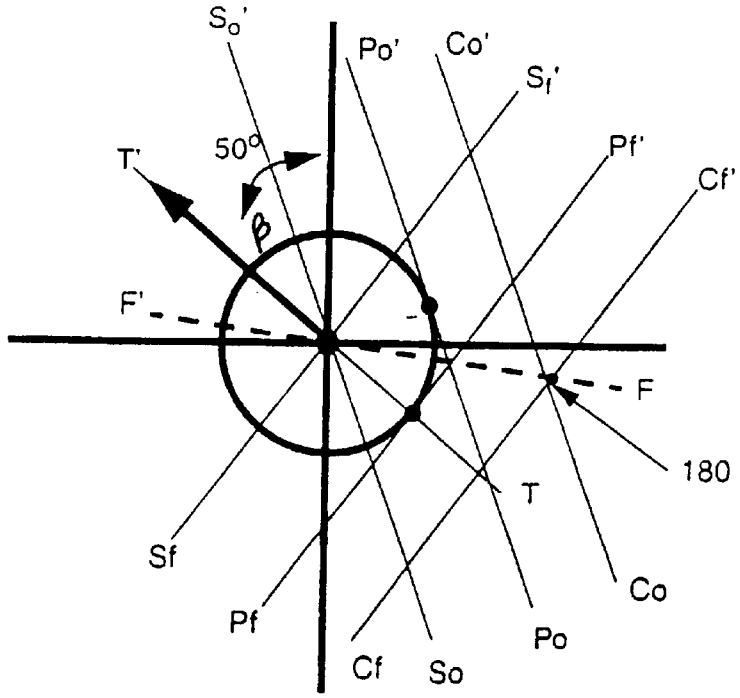

Another embodiment of the present invention is a method comprising the steps of selectively positioning the shoulder joints 304 at the intersection of a vertical and a horizontal set of reference planes; selecting a direction of an exercise motion at an angle β (within a predetermined range of 0° to 135°) relative to the vertical plane; constructing a motion plane T–T' passing through the shoulder joints axis 405 and coincident with the direction of exercise motion; and constructing a body circle 408 (FIG. 28) centered on the shoulder joints 304 with a radius equal to 4.1 inches, which is the median body thickness as measured from the center of the shoulder joint 304 to the contact point between a user's back and the bench pad. The next step includes constructing an approximate 2.5" square 410 centered on axis 405 which establishes a functional zone 410 of offset allowable for shoulder joints 304 relative to axis 405, as shown in FIG. 29. The next step involves selecting the desired operational exercise bench angles $\gamma_o$, $\gamma_f$ relative to the horizontal reference plane and defining γ as the total exercise range angle, constructing a plane $S_o$–$S_o'$ through axis 405 at the angle $\gamma_o$ and plane $S_f$–$S_f'$ through axis 405 at the angle $\gamma_f$, as shown in FIG. 30, and constructing bench pad planes $P_o$–$P_o'$ and $P_f$–$P_f'$ parallel to planes $S_o$–$S_o'$ and $S_f$–$S_f'$, respectively, and tangent to body circle 408, as shown in FIG. 31. Tangency points $p_o$ and $p_f$ are thus established as the intersection of the respective pad planes and the body circle at the limits of the exercising angle range γ. The next steps include constructing a bench pivot axle plane F–F' through axis 405 and the intersection of bench pad planes $P_o$–$P_o'$ and $P_f$–$P_f'$, as shown in FIG. 32, whereby bench pivot axles 72 (FIG. 18), 180 (FIG. 27) lie on plane F–FF', constructing pivot planes $C_o$–$C_o'$ and $C_f$–$C_f'$(FIG. 33) parallel to the respective bench pad planes $P_o$–$P_o'$ and $P_f$–$P_f'$ and offset at a thickness w equal to the combined bench pad and frame thickness, i.e., from the top of the bench pad to the bench pivot axle, such as is shown to be 3" in FIG. 27, and determining the optimal location for the bench pivot axle (72, 180) as the insersection of pivot planes $C_o$–$C_o'$ and $C_f$–$C_f'$, as shown in FIG. 33.

The ideal location for bench pivot axles 72 or 180 is colinear with shoulder joint 304 and shoulder joint axis 405. The design discussed in the embodiments of FIGS. 3 and 27 does not always allow for this to occur. The above method discusses an optimization procedure by which the designer can locate an optimal position for bench pivot axle 72 or 180 and have the design function for the desired pressing/extension exercises of the shoulder join. If the above method is followed. the arms will track through the motion plane T–T' for all angles $\gamma$.

After performing the above method steps, the designer should check the planar construction outlined at an intermediate angle $\gamma_i$ midway between $\gamma_o$ and $\gamma_f$. The bench pad will contact the body circle 408 for all angles $\gamma$. The body circle 408 move concurrent with the bench pad as it is adjusted to this intermediate $\gamma_i$ angular position. The shoulder joint 304 and shoulder joint axis 405, defined as the center of body circle 408, must still be found to be within functional zone 410. If shoulder joint 304 and shoulder join axis 405 are found to move outside of zone 410 at this intermediate $\gamma_i$ then a new (combined bench pad and frame) thickness w must be chosen and the construction process repeated, thereby further optimizing the position of bench pivot axles 72 or 180.

As stated earlier the machine is functional in a zone about the initial point 405. The placement of 180 can thus be approximated and evaluated quickly using this zone and the method discussed herein.

While this invention has been described with reference to its presently preferred embodiments(s), its scope is only limited insofar as defined by the following set of claims and equivalents thereof. In particular, all dimensions provided herein are for nonlimitative examples only and a person skilled in the art may change any dimension disclosed without departing from the inventive scope of the present invention.

What is claimed is:

1. A method for determining a bench pivot axle position on a support frame of an exercise machine including a bench adapted to pivot about the bench pivot axle and equipped with a bench pad, the support frame and bench pad having a combined thickness w, said method comprising the steps of;

(a) determining a likely position of a user's shoulder joint relative to the support frame;

(b) constructing vertical and horizontal reference planes through the likely position of the shoulder joint to define a shoulder joint axis at the intersection of said vertical and horizontal reference planes;

(c) selecting a direction of an exercise motion at an angle $\beta$ within a predetermined range of 0° to 135° relative to said vertical reference plane;

(d) constructing a motion plane T–T' at said angle $\beta$ and passing through said shoulder joint axis coincident with said selected direction of exercise motion;

(e) constructing a body circle centered on said shoulder joint axis with a radius equal to about 4.1 inches;

(f) constructing an approximate 2.5 inch square centered on said shoulder joint axis to establish a functional zone of offset for the shoulder joint relative to said shoulder joint axis;

(g) selecting desired operational exercise bench angles $\gamma_o$, $\gamma_f$ relative to said horizontal reference plane and defining $\gamma$ as the total exercise range angle;

(h) constructing a plane $S_o$–$S_o'$ through said shoulder joint axis at said angle $\gamma_o$ and a plane $S_f$–$S_f'$ through said shoulder joint axis at said angle $\gamma_f$;

(i) constructing a pair of intersecting bench pad planes $P_o$–$P_o'$ and $P_f$–$P_f'$ parallel to said planes $S_o$–$S_o'$ and $S_f$–$S_f'$, respectively, and tangent to said body circle;

(j) constructing a bench pivot axle plane F–F' through said shoulder joint axis and the intersection of said bench pad planes $P_o$–$P_o'$ and $P_f$–$P_f'$;

(k) constructing a pair of intersecting pivot planes $C_o$–$C_o'$ and $C_f$–$C_f'$ parallel to the respective bench pad planes $P_o$–$P_o'$ and $P_f$–$P_f'$ and offset by the combined thickness w; and (l) establishing an optimal bench pivot axle location at the intersection of said $C_o$–$C_o'$ and $C_f$–$C_f'$ planes, said optimal bench pivot axle location lying on said bench pivot axle plane F–F'.

2. A method for determining a bench pivot axle position on a support frame of an exercise machine including a bench adapted to pivot about the bench pivot axle and equipped with a bench pad, the support frame and bench pad having a combined thickness w, said method comprising the steps of:

(a) determining a likely position of a user's shoulder joint relative to the support frame;

(b) constructing vertical and horizontal reference planes through the likely position of the shoulder joint to define a shoulder joint axis at the intersection of said vertical and horizontal reference planes;

(c) positioning said shoulder joint axis between 29.5 inches and 32.0 inches forward of a vertical frame member and between 22.5 inches and 26.0 inches vertically above a base frame member of the support frame;

(d) selecting a direction of an exercise motion at an angle $\beta$ within a predetermined range of 0° to 135° relative to said vertical reference plane;

(e) constructing a motion plane T–T' at said angle $\beta$ and passing through said shoulder joint axis coincident with said selected direction of exercise motion;

(f) constructing a body circle centered on said shoulder joint axis with a radius equal to about 4.1 inches;

(g) constructing an approximate 2.5 inch square centered on said shoulder joint axis to establish a functional zone of offset for the shoulder joint relative to said shoulder joint axis;

(h) selecting desired operational exercise bench angles $\gamma_o$, $\gamma_f$ relative to said horizontal reference plane and defining $\gamma$ as the total exercise range angle;

(i) constructing a plane $S_o$–$S_o'$ through said shoulder joint axis at said angle $\gamma_o$ and a plane $S_f$–$S_f'$ through said shoulder joint axis at said angle $\gamma_f$;

(j) constructing a pair of intersecting bench pad planes $P_o$–$P_o'$ and $P_f$–$P_f'$ parallel to said planes $S_o$–$S_o'$ and $S_f$–$S_f'$, respectively, and tangent to said body circle;

(k) constructing a bench pivot axle plane F–F' through said shoulder joint axis and the intersection of said bench pad planes $P_o$–$P_o'$ and $P_f$–$P_f'$;

(l) constructing a pair of intersecting pivot planes $C_o$–$C_o'$ and $C_f$–$C_f'$ parallel to the respective bench pad planes $P_o$–$P_o'$ and $P_f$–$P_f'$ and offset by the combined thickness w; and (m) establishing an optimal bench pivot axle location at the intersection of said $C_o$–$C_o'$ and $C_f$–$C_f'$ planes, said optimal bench pivot axle location lying on said bench pivot axle plane F–F'.

3. The method of claim 2, wherein step (c) further includes positioning said shoulder joint axis 30.9 inches forward of said vertical frame member.

4. The method of claim 2, wherein step (c) further includes positioning said shoulder joint axis 24.2 inches vertically above said base frame member.

5. A method for determining a bench pivot axle position on a support frame of an exercise machine including a bench adapted to pivot about the bench pivot axle and equipped with a bench pad, the support frame and bench pad having a combined thickness w, said method comprising the steps of:

(a) constructing a pair of intersecting vertical and horizontal references planes through the center of a user's shoulder joint being placed in a likely position relative to the support frame to define a shoulder joint axis at the intersection of said vertical and horizontal reference planes;

(b) restraining an user's arm to articulate in a motion plane passing through said shoulder joint axis and being disposed at an angle β relative to said vertical reference plane;

(c) constructing a body circle centered on said shoulder joint axis and having a radius equal to a median body thickness;

(d) establishing a functional zone of shoulder joint offset relative to said shoulder joint axis within said body circle, said functional zone being centered on said shoulder joint axis;

(e) constructing a pair of intersecting operational exercise bench position planes through the center of the user's shoulder joint at selected initial and final bench positional angles $\gamma_o$, $\gamma_f$ relative to said horizontal reference plane;

(f) constructing a pair of intersecting bench pad planes parallel to said pair of operational exercise bench position planes, respectively, and tangent to said body circle;

(g) constructing a bench pivot axle plane through said shoulder joint axis and the intersection of said bench pad planes; and (h) constructing a pair of intersecting planes parallel to said pair of bench pad planes and offset by the combined thickness w, respectively, to establish an optimal bench pivot axle location at the intersection of said pair of offset planes, said optimal bench pivot axle location lying on said bench pivot axle plane.

6. The method of claim 5, wherein the median body thickness of step (c) is measured from the center of the shoulder joint to a tangential point of contact between the user's back and the bench pad.

7. The method of claim 5, wherein the functional zone of step (d) is shaped as a square.

8. The method of claim 5, wherein angle β of step (b) is selected from a range of 0° to 135°.

* * * * *